US010946378B2

(12) United States Patent
Cummins et al.

(10) Patent No.: US 10,946,378 B2
(45) Date of Patent: Mar. 16, 2021

(54) PASSIVE PUMPS FOR MICROFLUIDIC DEVICES

(71) Applicant: North Carolina State University, Raleigh, NC (US)

(72) Inventors: Brian M. Cummins, Raleigh, NC (US); Frances Smith Ligler, Fuquay Varina, NC (US); Glenn Walker, Cary, NC (US)

(73) Assignee: North Carolina State University, Raleigh, NC (US)

( * ) Notice: Subject to any disclaimer, the term of this patent is extended or adjusted under 35 U.S.C. 154(b) by 236 days.

(21) Appl. No.: 15/074,652

(22) Filed: Mar. 18, 2016

(65) Prior Publication Data

US 2017/0065973 A1 Mar. 9, 2017

Related U.S. Application Data

(60) Provisional application No. 62/214,352, filed on Sep. 4, 2015.

(51) Int. Cl.
*B01L 3/00* (2006.01)
*F04B 37/04* (2006.01)
(Continued)

(52) U.S. Cl.
CPC ..... *B01L 3/50273* (2013.01); *B01L 3/5023* (2013.01); *B01L 3/502746* (2013.01);
(Continued)

(58) Field of Classification Search
CPC ..... B01L 2400/0406; B01L 2400/0457; B01L 3/50273; B01L 3/5023; B01L 3/502746;
(Continued)

(56) References Cited

U.S. PATENT DOCUMENTS 7,695,687 B2 4/2010 Delamarche et al.
8,921,118 B2 12/2014 Siegel et al.
(Continued)

FOREIGN PATENT DOCUMENTS

JP H03-223674 A 10/1991
JP 2001-088096 A 4/2001
(Continued)

OTHER PUBLICATIONS

Author: Wang et al. Title: Paper pump for passive and programmable transport Date published (mm/dd/yyyy): Feb. 6, 2013 Date accessed (mm/dd/yyyy): Mar. 29, 2018 Link: https://www.ncbi.nlm.nih.gov/pmc/articles/PMC3579862/pdf/BIOMGB-000007-014107_1.pdf.*

(Continued)

*Primary Examiner* — Kenneth J Hansen
*Assistant Examiner* — Chirag Jariwala
(74) *Attorney, Agent, or Firm* — Meunier Carlin & Curfman LLC

(57) ABSTRACT

Provided herein are passive microfluidic pumps. The pumps can comprise a fluid inlet, an absorbent region, a resistive region fluidly connecting the fluid inlet and the absorbent region, and an evaporation barrier enclosing the resistive region, the absorbent region, or a combination thereof. The resistive region can comprise a first porous medium, and a fluidly non-conducting boundary defining a path for fluid flow through the first porous medium from the fluid inlet to the absorbent region. The absorbent region can comprise a fluidly non-conducting boundary defining a volume of a second porous medium sized to absorb a predetermined volume of fluid imbibed from the resistive region. The resistive region and the absorbent region can be configured to establish a capillary-driven fluid front advancing from the (Continued)

fluid inlet through the resistive region to the absorbent region when the fluid inlet is contacted with fluid.

24 Claims, 23 Drawing Sheets

(51) Int. Cl.
*F04B 37/02* (2006.01)
*F04B 19/16* (2006.01)
*F04B 19/00* (2006.01)
*F04F 99/00* (2009.01)

(52) U.S. Cl.
CPC ..... *F04B 19/006* (2013.01); *F04B 19/16* (2013.01); *F04B 37/02* (2013.01); *F04B 37/04* (2013.01); *F04F 99/00* (2013.01); *B01L 2200/027* (2013.01); *B01L 2200/06* (2013.01); *B01L 2200/12* (2013.01); *B01L 2300/069* (2013.01); *B01L 2300/087* (2013.01); *B01L 2300/0816* (2013.01); *B01L 2300/0883* (2013.01); *B01L 2300/0887* (2013.01); *B01L 2300/12* (2013.01); *B01L 2300/126* (2013.01); *B01L 2400/0406* (2013.01); *B01L 2400/0457* (2013.01); *B01L 2400/084* (2013.01); *F05B 2280/50* (2013.01)

(58) Field of Classification Search
CPC ..... B01L 2200/12; B01L 2200/027; B01L 2200/06; B01L 2300/0887; B01L 2300/126; B01L 2300/087; B01L 2300/0883; B01L 2300/069; B01L 2300/12; B01L 2400/084; B01L 2300/0816; F04B 19/006; F04B 19/16; F04B 37/02; F04B 37/04; F04B 19/04; F04F 99/00; F05B 2280/50
USPC ..... 422/507
See application file for complete search history.

(56) References Cited

U.S. PATENT DOCUMENTS

| | | | | |
|---|---|---|---|---|
| 9,488,613 | B2 * | 11/2016 | Bosch | G01N 27/3275 |
| 2010/0288368 | A1 * | 11/2010 | Beebe | B01L 3/50273 137/12 |
| 2011/0209999 | A1 | 9/2011 | Sibbett et al. | |
| 2012/0288961 | A1 | 11/2012 | Yager et al. | |
| 2014/0134074 | A1 * | 5/2014 | Ovaska | B01L 3/5023 422/503 |
| 2014/0246334 | A1 | 9/2014 | Bosch et al. | |
| 2015/0132742 | A1 | 5/2015 | Thuo et al. | |
| 2015/0153338 | A1 * | 6/2015 | Hosimer | B01L 3/502 436/501 |
| 2017/0173578 | A1 * | 6/2017 | Crooks | G01N 21/78 |
| 2017/0322202 | A1 * | 11/2017 | Kobayashi | G01N 35/00029 |

FOREIGN PATENT DOCUMENTS

| | | | |
|---|---|---|---|
| JP | 2001088096 | A * | 4/2001 |
| JP | 2004-194652 | A | 7/2004 |
| JP | 2013002813 | A * | 1/2013 |
| JP | 2015-083963 | A | 4/2015 |
| WO | 01/26813 | A2 | 4/2001 |
| WO | 2009/107608 | A1 | 9/2009 |
| WO | 2014/051033 | A1 | 3/2014 |

OTHER PUBLICATIONS

Author: Prakash et al. Title: Small volume PCR in PDMS biochips with integrated fluid control and vapour barrier Date published (mm/dd/yyyy): Apr. 28, 2005 Date accessed (mm/dd/yyyy): Mar. 29, 2018 Link: https://www.sciencedirect.com/science/article/pii/S0925400505003308.*

Author: Po Ki Yuen Title: Fluid control in microfluidic devices using a fluid conveyance extension and an absorbent microfluidic flow modulator Date published (mm/dd/yyyy): Mar. 19, 2013 Date accessed (mm/dd/yyyy): Mar. 29, 2018 Link: http://pubs.rsc.org/en/content/articlepdf/2013/lc/c3lc40956b.*

Author: Zimmermann et al. Title: Capillary pumps for autonomous capillary systems Date published (mm/dd/yyyy): Oct. 17, 2006 Date accessed (mm/dd/yyyy): Mar. 29, 2018 Link: https://pdfs.semanticscholar.org/5dbf/0aa25530cde291a84f2f1d598b5bf0d2f21b.pdf.*

Author: Lu et al. Title: Rapid prototyping of paper-based microfluidics with wax for low-cost, portable bioassay Date published (mm/dd/yyyy): Nov. 10, 2008 Date accessed (mm/dd/yyyy): Mar. 11, 2019 Link: https://onlinelibrary.wiley.com/doi/epdf/10.1002/elps.200800563 (Year: 2008).*

Author: Christopher et al. Title: Laminated paper-based analytical devices (LPAD): fabrication, characterization, and assays Date published (mm/dd/yyyy): Jan. 25, 2013 Date accessed (mm/dd/yyyy): Mar. 11, 2019 Link: https://link.springer.com/content/pdf/10.1007%2Fs10404-013-1140-x.pdf (Year: 2013).*

Author: Walker et al. Title: A passive pumping method for microfluidic devices Date published (mm/dd/yyyy): Aug. 5, 2002 Date accessed (mm/dd/yyyy): Oct. 2, 2019 Link: https://pubs.rsc.org/en/content/articlepdf/2002/lc/b204381e (Year: 2002).*

Author: Kim et al. Title: Preprogrammed capillarity to passively control system-lebel sequential and parallel microfluidic flows Date published (mm/dd/yyyy): Jun. 7, 2013 Date accessed (mm/dd/yyyy): Oct. 3, 2019 Link: https://www.ncbi.nlm.nih.gov/pmc/articles/PMC3664099/pdf/nihms-470416.pdf (Year: 2013).*

Author: Rich et al. Title: Characterization of glass frit capillary pumps for microfluidic devices Date published (mm/dd/yyyy): Apr. 11, 2019 Date accessed (mm/dd/yyyy): Jun. 16, 2020 Link: https://link.springer.com/article/10.1007/s10404-019-2238-6 (Year: 2019).*

Author: Kokalj et al. Title: Self-powered Imbibing Microfluidic Pump by Liquid Encapsulation: SIMPLE Date published (mm/dd/yyyy): Sep. 11, 2014 Date accessed (mm/dd/yyyy): Nov. 4, 2020 Link: https://pubs.rsc.org/en/content/articlepdf/2014/lc/c4lc00920g (Year: 2014).*

Author: Martinez et al. Title: Diagnostics for the Developing World: Microfluidic Paper-Based Analytical Devices Date published (mm/dd/yyyy): Dec. 9, 2009 Date accessed (mm/dd/yyyy): Nov. 4, 2020 Link: https://pubs.acs.org/doi/pdf/10.1021/ac9013989 (Year: 2009).*

International Search Report and Written Opinion issued by the International Searching Authority in Application No. PCT/US2016/023262 dated Jun. 17, 2016, 11 pages.

Wang, Xiao, Joshua A. Hagen, and Ian Papautsky. "Paper pump for passive and programmable transport." Biomicrofluidics 7.1 (2013): 014107.

Yuen, Po Ki. "Fluid control in microfluidic devices using a fluid conveyance extension and an absorbent microfluidic flow modulator." Lab on a Chip 13.9 (2013): 1737-1742.

Zimmermann, Martin, et al. "Capillary pumps for autonomous capillary systems." Lab on a Chip 7.1 (2007): 119-125.

Prakash, A. Ranjit, et al. "Small volume PCR in PDMS biochips with integrated fluid control and vapour barrier." Sensors and Actuators B: Chemical 113.1 (2006): 398-409.

The Extended European Search Report issued for European Application No. 16842448.9, dated Dec. 17, 2018, 15 pages.

Kevin M. Schilling et al: "Fully Enclosed Microfluidic Paper-Based Analytical Devices", Analytical Chemistry, vol. 84, No. 3, 2012, pp. 1579-1585.

Christopher L. Cassano et al: "Laminated paper-based analytical devices (LPAD): fabrication, characterization, and assays", Microfluidics and Nanofluidics, vol. M 5, No. 2, 2013, pp. 173-181.

Andres W. Martinez et al: "Diagnostics for the Developing World: Microfluidic Paper-Based Analytical Devices", Analytical Chemistry, vol. 82, No. 1, 2009, pp. 3-10.

(56) References Cited

OTHER PUBLICATIONS

Xiao Wang et al: "Paper pump for passive and programmable transport", Biomicrofluidics, vol. 71, No. 1, 2013, pp. 14107(1)-1107(11).
David R Ballerini et al: "Patterned paper and alternative materials as substrates for low-cost microfluidic diagnostics", Microfluidics and Nanofluidics, Springer, Berlin, DE, vol. 13, No. 5, 2012, pp. 769-787.
Notice of Reasons for Rejection issued in corresponding Japanese application No. 2018-0531290, dated Feb. 12, 2020.
Communication Pursuant to Article 94(3) EPC issued in corresponding European application No. 16842488.9, dated Mar. 27, 2020, 10 pages.
Brian M. Cummins et al: "Time-Dependent Model for Fluid Flow in Porous Materials with Multiple Pore Sizes", Analytical Chemistry, vol. 89, No. 8, Mar. 28, 2017.
Japanese Notice of Decision of Rejection, dated Aug. 28, 2020, with English translation.

* cited by examiner

Pumps betwen the microchannel and the last pump
have open connections on both sides of port to allow stacking

PASSIVE PUMPS FOR MICROFLUIDIC DEVICES

CROSS-REFERENCE TO RELATED APPLICATIONS

This application claims benefit of U.S. Provisional Application No. 62/214,352 filed Sep. 4, 2015, is hereby incorporated herein by reference in its entirety.

STATEMENT REGARDING FEDERALLY SPONSORED RESEARCH OR DEVELOPMENT

This invention was made with Government Support under Grant No. UL1TR001111 awarded by the National Institutes of Health. The Government has certain rights in the invention.

BACKGROUND

With the desire to move many diagnostic tests to the point of use, microfluidic devices have incredible potential for widespread use in healthcare, environmental monitoring, food safety, and other applications. In particular, the ability of microfluidic systems to process small volumes of liquid renders them well suited for many well suited for many bio-analytical applications.

Despite their many advantages, some significant technical hurdles have prevented the widespread adoption of microfluidic devices for many applications. For example, most microfluidics rely on bulky, expensive pumps to direct and control the fluid flow within the device. Such external pumps are typically required because precise control of fluid flow offers advantages for many applications. For example, by carefully controlling/optimizing fluid flow, one can increase the sensitivity of tests (e.g., immunoassays), transfer products from cell cultures for analysis, and minimize the effect of the depletion zones that limit target binding to immobilized recognition molecules in biosensors. However, the need for complex and/or expensive external instrumentation, such as pumps, dramatically limits the potential use of microfluidic tests for point-of-care diagnostics, food and water testing, and environmental monitoring, particularly in low resource environments. In order for these microfluidic devices to be simple to use, more affordable, and more reliable in operation, improved devices and methods for controlling fluid flow within microfluidic devices are needed.

SUMMARY

Provided herein are microfluidic pumps. The pumps (including the hybrid pumps and compound pumps described herein) are simple to fabricate, inexpensive, and provide for facile and accurate control of fluid flow through attached microfluidic systems. Further, the pumps are passive (i.e., require no energy input), and can be designed to be disposable, biodegradable, and/or combustible.

The passive microfluidic pumps comprise a fluid inlet, an absorbent region, a resistive region fluidly connecting the fluid inlet and the absorbent region, and an evaporation barrier enclosing the resistive region, the absorbent region, or a combination thereof. The resistive region can comprise a first porous medium, and a fluidly non-conducting boundary defining a path for fluid flow through the first porous medium from the fluid inlet to the absorbent region. The absorbent region can comprise a fluidly non-conducting boundary defining a volume of a second porous medium sized to absorb a predetermined volume of fluid imbibed from the resistive region. The resistive region and the absorbent region can be configured to establish a capillary-driven fluid front advancing from the fluid inlet through the resistive region to the absorbent region when the fluid inlet is contacted with fluid.

The dimensions and properties of the resistive region and the absorbent region can be selected to provide a passive pump configured to produce a desired fluid flow rate profile (e.g. constant, step-increase, step-decrease, oscillating, gradually increasing or decreasing) when fluidly connected to a microfluidic device. For example, in certain embodiments, the resistance to fluid flow through the resistive region is greater (e.g., at least five times greater, at least ten times greater, or at least twenty times greater) than the resistance to fluid flow through the absorbent region. In these embodiments, the dimensions and properties of the resistive region can be modified to select the flow rate provided by the pump when the pump is fluidly connected to a microfluidic device. In certain embodiments, the resistive region is configured to provide a rate of fluid flow of from 1 nL/min to 100 μL/min as the capillary-driven fluid advances through the second porous medium from the resistive region. Likewise, the dimensions and properties of the absorbent region can be modified to select a predetermined volume of fluid to be pumped at the flow rate determined by the resistive region. For example, the absorbent region can be sized to absorb from 1 μL to 10 mL (e.g., 10 μL to 10 mL) of fluid imbibed from the resistive region. In certain embodiments, the resistive region can be configured to provide a rate of fluid flow effective to deliver the predetermined volume of fluid to the absorbent region in from 10 seconds to 7 days (e.g., from 0.1 minutes to 90 minutes).

If desired, the pumps described herein can further include a flow delay element to influence fluid flow though the pump. For example, the pump can further comprise a dissolvable solute disposed in the fluid inlet, the resistive region, or a combination thereof. The pump can also comprise a dissolvable membrane forming a barrier to fluid flow through elements of the pump.

The evaporation barrier can enclose the resistive region, the absorbent region, or a combination thereof. In some cases, the evaporation barrier can enclose the resistive region. In some cases, the evaporation barrier can enclose the absorbent region. In certain embodiments, the evaporation barrier can enclose both the resistive region and the absorbent region. In cases where the evaporation barrier encloses the absorbent region, the pump can further include a vent operatively coupled to the absorbent region (e.g., to allow for pressure equalization as the absorbent region fills with fluid).

In some embodiments, the passive microfluidic pump can further include a second (or more) absorbent region. Such pumps are referred to herein as "hybrid pumps." Such pumps can be designed to induce more complex fluid flow rate profiles when fluidly connected to a microfluidic device. For example, in some embodiments, the pump can further comprise a second resistive region and a second absorbent region. The second absorbent region can be fluidly connected in parallel or in series to the first absorbent region.

For example, in some embodiments, the second absorbent region can be fluidly connected in parallel to the first absorbent region. In these embodiments, the second resistive region can comprise a third porous medium, and a fluidly non-conducting boundary defining a path for fluid flow through the third porous medium from the fluid inlet to the second absorbent region, and the second absorbent region can comprise a fluidly non-conducting boundary defining a volume of a fourth porous medium sized to absorb a predetermined volume of fluid imbibed from the second resistive region. In certain cases, the pump can further include flow delay element(s) to influence fluid flow though the pump. For example, in some embodiments, the pump can further comprise a dissolvable solute disposed in the second resistive region. In some embodiments, the pump can further comprise a dissolvable membrane forming a barrier to fluid flow from the fluid inlet into the second resistive region.

In some embodiments, the second absorbent region can be fluidly connected in series to the first absorbent region. In these embodiments, the second resistive region can comprise a third porous medium, and a fluidly non-conducting boundary defining a path for fluid flow through the third porous medium from the first absorbent region to the second absorbent region; and the second absorbent region can comprise a fluidly non-conducting boundary defining a volume of a fourth porous medium sized to absorb a predetermined volume of fluid imbibed from the second resistive region. In certain cases, the pump can further include flow delay element(s) to influence fluid flow though the pump. For example, in some embodiments, the pump can further comprise a dissolvable solute disposed in the second resistive region. In some embodiments, the pump can further comprise a dissolvable membrane forming a barrier to fluid flow from the first absorbent region to the second resistive region.

In some embodiments, the hybrid pump can include three or more absorbent regions. For example, the hybrid pump can include three or more absorbent regions fluidly connected in parallel via resistive regions. The hybrid pump can also include three or more absorbent regions fluidly connected in series via resistive regions. In some cases, the hybrid pump can include absorbent regions fluidly connected both in parallel and in series. For example, in some embodiments, the hybrid pump can comprise two or more absorbent regions fluidly connected in parallel via resistive regions, and two or more absorbent regions fluidly connected in series via resistive regions.

The porous medium making up regions of the pumps described herein can be formed from any suitable porous material. Suitable porous materials can be selected in view of a number of factors, including the identity of the fluid to be transported by the pump (e.g., an aqueous fluid or an organic fluid) and the desired fluid flow rate profile to be induced by the pump. For example, in the case of pumps configured to drive the flow of aqueous solutions, the porous materials can comprise a porous hydrophilic material. In certain embodiments, the porous materials can comprise a cellulosic substrate (e.g., paper, cellulose derivatives, woven cellulose materials, non-woven cellulose materials, or a combination thereof). In certain embodiments, the pump can be a paper-based pump (i.e., the porous materials can comprise paper). Examples of suitable papers include, but are not limited to, chromatography paper, card stock, filter paper, vellum paper, printing paper, wrapping paper, ledger paper, bank paper, bond paper, blotting paper, drawing paper, fish paper, tissue paper, paper towel, wax paper, and photography paper.

In some embodiments, the porous regions of the pumps described herein (e.g., the first porous medium and the second porous medium) can be formed within a single piece of substrate material. In other embodiments, the porous regions of the pumps described herein (e.g., the first porous medium and the second porous medium) comprise separate pieces of substrate material that are in fluid contact with one another (e.g., separate pieces of substrate material that are abutted to one another). In these embodiments, the separate pieces of substrate material have the same thickness or a different thickness. In one example, the piece of substrate material forming the second porous medium can be thicker than the piece of substrate material forming the first porous material (i.e., the porous medium forming the absorbent region can be thicker than the porous medium forming the resistive region). In some cases, the piece of substrate material forming the second porous medium and the piece of substrate material forming the first porous material are not coplanar. In certain cases, the absorbent region is non-planar. For example, if desired, the absorbent region can be folded or bent into a three dimensional shape to reduce the footprint of the absorbent region (and by extension, the overall footprint of the pump).

In one embodiment, the absorbent region can be detachably connected to the resistive region. In this way, the absorbent region can be removed (e.g., once filled with a fluid), and replaced with a fresh absorbent region (e.g., allowing the pump to imbibe another volume of fluid). If desired, detachable absorbent regions can be used, for example, to collect multiple fractions of fluid for subsequent analysis.

If desired, the pumps described herein can be integrally formed within larger microfluidic devices to provide for control of fluids within the microfluidic device. In other cases, the pumps described herein can be modular in construction, and configured to be readily attached to an external microfluidic device. In this way, the pumps described herein can be used in a 'plug-and-play' fashion to control fluid flow in a wide range of conventional microfluidic devices. In certain embodiments, the fluid inlet can be configured to fluidly connect with a microfluidic channel. Specifically, the fluid inlet can have a geometry and construction that facilitates attachment of the pump with a microfluidic device (e.g., an external microfluidic device). By way of example, the fluid inlet can comprise a fluidly conductive region defining a path for fluid flow to the first resistive region. The fluidly conductive region can comprise, for example, a porous medium forming a path for fluid flow to the first resistive region. The fluidly conductive region can also comprise an open air-filled channel and/or a conductive material (e.g., glass beads, fiberglass, and/or glass wool) which provides a path for fluid flow to the first resistive region.

Also provided herein are compound pumps comprising a plurality of fluidly connected pumps or hybrid pumps described herein. The plurality of the pumps can be fluidly connected in parallel, in series, or with pumps fluidly connected both in parallel and in series. In some embodiments, the plurality of the pumps can comprise two or more pumps fluidly connected in series. In some embodiments, the plurality of the pumps can comprise two or more pumps fluidly connected in parallel. In certain embodiments, the plurality of the pumps can comprise two or more pumps fluidly connected in series and two or more pumps fluidly connected in parallel.

The plurality of pumps can be fluidly connected in any suitable fashion. In certain embodiments, the plurality of the pumps are stacked in parallel planes. Optionally, compound pumps can further include flow delay element(s) to influence fluid flow though the compound pump (e.g., into at least one of the plurality of fluidly connected pumps). For example, in some embodiments, the pump can further comprise a dissolvable solute disposed in the fluid inlet of a pump in the compound pump, the resistive region of the pump in the compound pump, or a combination thereof. In some embodiments, the pump can further comprise a dissolvable membrane forming a barrier to fluid flow between two of the plurality of the pumps in the compound pump.

Also provided are microfluidic devices that include one or more of the passive pumps described herein. Example microfluidic devices can include a microfluidic channel fluidly connecting a fluid inlet to a fluid outlet, and a pump described herein (e.g., a pump, hybrid pump, and/or compound pump) fluidly connected to the fluid outlet of the microfluidic channel (e.g., such that the pump induces fluid flow through the microfluidic channel when the fluid inlet is contacted with fluid). In some cases, the fluid inlet of the pump can be in direct contact with the fluid outlet of the microfluidic channel. In certain embodiments, the pump can be configured to drive fluid flow through the microfluidic channel at a substantially continuous flow rate for a period of at least 0.1 minutes (e.g., at least 0.5 minutes, at least 1 minutes, at least 5 minutes, at least 10 minutes, at least 30 minutes, at least 60 minutes, or longer). In other embodiments, the pump can be configured to drive fluid flow through the microfluidic channel at a variable flow rate for a period of at least 10 minutes (e.g., at least 30 minutes, at least 60 minutes, or longer). The variable flow rate can comprise, for example, a stepwise increasing flow rate or a stepwise decreasing flow rate.

Also provided are methods of using the pumps (including the hybrid pumps and compound pumps) described herein. The pumps described herein can be used to induce fluid flow through an attached microfluidic device (e.g., to achieve a controlled flow rate for a set volume, and/or to achieve multiple predetermined flow rates through the device). Accordingly, also provided are methods for inducing fluid flow through a microfluidic device that comprise fluidly connecting a pump described herein to a fluid outlet of the microfluidic device; and contacting a fluid inlet of the microfluidic device with a fluid. In some embodiments, the pump can be directly connected to the fluid outlet of the microfluidic device. In certain embodiments, the pump can be configured to drive fluid flow through the microfluidic channel at a substantially continuous flow rate for a period of at least 0.1 minutes (e.g., at least 0.5 minutes, at least 1 minutes, at least 5 minutes, at least 10 minutes, at least 30 minutes, at least 60 minutes, or longer). In other embodiments, the pump can be configured to drive fluid flow through the microfluidic channel at a variable flow rate for a period of at least 10 minutes (e.g., at least 30 minutes, at least 60 minutes, or longer). The variable flow rate can comprise, for example, a stepwise increasing flow rate or a stepwise decreasing flow rate.

The pumps (including the hybrid pumps and compound pumps described herein) can also be used in process control applications. For example, pumps described herein can be used to determine the fluidic resistance of microfluidic channels, to measure the height of microfluidic channels, to quantify the properties (e.g. the permeability) of a porous material such as paper, and/or to quantify the properties (e.g., the viscosity) of an unknown fluid.

Given the modular nature of the pumps described herein, individual modular pumps can be readily assembled to form a compound pump to provide a predetermined fluid flow rate within a microfluidic channel. Accordingly, also provided are methods of assembling passive compound pumps configured to provide a predetermined fluid flow rate within a microfluidic channel. These methods can comprise fluidly connecting one or more pumps described herein (referred to in this context as a "pump subunit") shaped to induce a particular fluid flow rate upon contact with a fluid to a fluid inlet to form the passive compound pump. Each pump subunit can comprise a resistive region comprising a first porous medium, and a fluidly non-conducting boundary defining a path for fluid flow through the first porous medium from the fluid inlet to the absorbent region, and an absorbent region comprising a fluidly non-conducting boundary defining a volume of a second porous medium sized to absorb a predetermined volume of fluid imbibed from the resistive region. Optionally, each pump subunit can be enclosed within an evaporation barrier.

In some embodiments, methods of assembling a passive compound pump can comprise fluidly connecting two or more pump subunits. In some embodiments, methods can comprise fluidly connecting two or more pump subunits in series. In some embodiments, methods can comprise fluidly connecting two or more pump subunits in parallel. In certain embodiments, methods can comprise fluidly connecting two or more pump subunits in series, and fluidly connecting two or more pump subunits in parallel. In certain embodiments, fluidly connecting the pump subunits can comprise stacking the pump subunits to form the fluid inlet. In these embodiments, the fluid inlet can comprise a fluidly conductive region extending through the pump subunits in the stack, and defining a path for fluid flow to the first resistive region of each of the pump subunits. The fluidly conductive region can comprise, for example, a porous medium forming a path for fluid flow. The fluidly conductive region can also comprise an open air-filled channel and/or a conductive material (e.g., fiberglass or glass wool) which provides a path for fluid flow. In some embodiments, methods can further comprise positioning a dissolvable membrane between pump subunits in the stack (e.g., transecting the fluid inlet) so as to form a barrier to fluid flow between pump subunits in the compound pump.

DESCRIPTION OF DRAWINGS

FIG. 11 also includes a plot of the volumetric flow rate profile for P1, P2, P3, and P4 (4.5 μL/min, 2.3 μL/min, 1 μL/min, and 0.5 μL/min, respectively).

FIG. 12 also includes a plot of the volumetric flow rate profile for P1, P2, and P3.

FIG. 13A is an exploded view, and FIG. 13B is a perspective view of the assembled assembly.

As shown in FIG. 21, by combining these in varying fashions, complex programmable fluid flow rate profiles can be generated.

DETAILED DESCRIPTION

Figure 1:
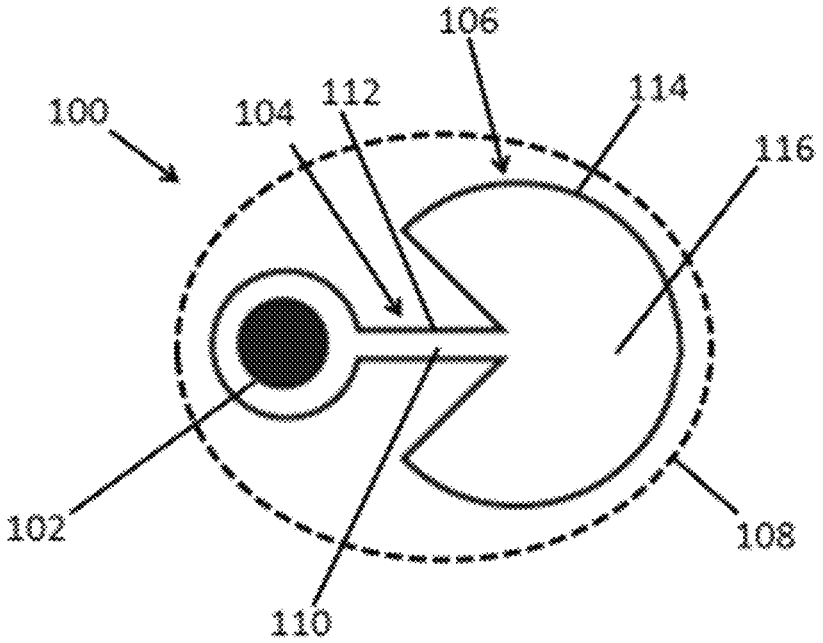
FIG. 1 is a schematic illustration of an example passive microfluidic pump.

The methods and devices described herein may be understood more readily by reference to the following detailed description of specific aspects of the disclosed subject matter, figures and the examples included therein.

Before the present devices and methods are disclosed and described, it is to be understood that the aspects described below are not intended to be limited in scope by the specific devices and methods described herein, which are intended as illustrations. Various modifications of the devices and methods in addition to those shown and described herein are intended to fall within the scope of that described herein. Further, while only certain representative devices and method steps disclosed herein are specifically described, other combinations of the devices and method steps also are intended to fall within the scope of that described herein, even if not specifically recited. Thus, a combination of steps, elements, components, or constituents may be explicitly mentioned herein or less; however, other combinations of steps, elements, components, and constituents are included, even though not explicitly stated.

The term "comprising" and variations thereof as used herein is used synonymously with the term "including" and variations thereof and are open, non-limiting terms. Although the terms "comprising" and "including" have been used herein to describe various examples, the terms "consisting essentially of" and "consisting of" can be used in place of "comprising" and "including" to provide for more specific examples of the invention and are also disclosed. Other than in the examples, or where otherwise noted, all numbers expressing quantities of ingredients, reaction conditions, and so forth used in the specification and claims are to be understood to be construed in light of the number of significant digits and ordinary rounding approaches.

As used in the description and the appended claims, the singular forms "a," "an," and "the" include plural referents unless the context clearly dictates otherwise. Thus, for example, reference to "a composition" includes mixtures of two or more such compositions, reference to "an agent" includes mixtures of two or more such agents, reference to "the component" includes mixtures of two or more such components, and the like.

"Optional" or "optionally" means that the subsequently described event or circumstance can or cannot occur, and that the description includes instances where the event or circumstance occurs and instances where it does not.

"Multiple" or "plurality" as used herein, is defined as two or more than two.

It is understood that throughout this specification the identifiers "first" and "second" are used solely to aid in distinguishing the various components and steps of the disclosed subject matter. The identifiers "first" and "second" are not intended to imply any particular order, amount, preference, or importance to the components or steps modified by these terms.

Also, throughout this specification, various publications are referenced. The disclosures of these publications in their entireties are hereby incorporated by reference into this application in order to more fully describe the state of the art to which the disclosed matter pertains. The references disclosed are also individually and specifically incorporated by reference herein for the material contained in them that is discussed in the sentence in which the reference is relied upon.

Passive Pumps

Provided herein are microfluidic pumps. The pumps (including the hybrid pumps and compound pumps described herein) are simple to fabricate, inexpensive, and provide for facile and accurate control of fluid flow through attached microfluidic systems. Further, the pumps are passive (i.e., require no energy input), and can be designed to be disposable, biodegradable, and/or combustible.

An example passive microfluidic pump is schematically illustrated in FIG. 1. The pump (100) can comprise a fluid inlet (102), an absorbent region (106), a resistive region (104) fluidly connecting the fluid inlet and the absorbent region, and an evaporation barrier (108) enclosing the resistive region, the absorbent region, or a combination thereof. The resistive region (104) can comprise a first porous medium (110), and a fluidly non-conducting boundary (112) defining a path for fluid flow through the first porous medium from the fluid inlet (102) to the absorbent region (106). The absorbent region (106) can comprise a fluidly non-conducting boundary (114) defining a volume of a second porous medium (116) sized to absorb a predetermined volume of fluid imbibed from the resistive region. The resistive region and the absorbent region can be configured to establish a capillary-driven fluid front advancing from the fluid inlet through the resistive region to the absorbent region when the fluid inlet is contacted with fluid.

The dimensions and properties of the resistive region and the absorbent region can be selected to provide a passive pump configured to produce a desired fluid flow rate profile when fluidly connected to a microfluidic device. For example, in certain embodiments, the resistive region can be sized such that the resistance to fluid flow through the resistive region is greater than the resistance to fluid flow through the absorbent region. In some embodiments, the resistance to fluid flow through the resistive region can be at least five times greater (e.g., at least ten times greater, at least fifteen times greater, at least twenty times greater, at least twenty-five times greater, or at least fifty times greater) than the resistance to fluid flow through the absorbent region. In certain cases, the resistance to fluid flow through the resistive region can be from five times greater to one thousand times greater (e.g., from five times greater to five hundred times greater, from five times greater to one hundred times greater, from five times greater to fifty times greater, from five times greater to twenty-five times greater, from five times greater to twenty times greater, or from ten times greater to twenty times greater) than the resistance to fluid flow through the absorbent region.

In these embodiments, the dimensions and properties of the resistive region can be modified to select the flow rate provided by the pump when the pump is fluidly connected to a microfluidic device. In certain embodiments, the resistive region is configured to provide a rate of fluid flow of from 1 nL/min to 100 μL/min (e.g., from 100 nL/min to 100 μL/min, from 1 μL/min to 100 μL/min, or from 1 μL/min to 10 μL/min) as the capillary-driven fluid advances through the second porous medium from the resistive region. In certain embodiments, the resistive region can be configured to provide a rate of fluid flow effective to deliver the predetermined volume of fluid to the absorbent region in from 5 seconds to 7 days (e.g., from 0.1 minutes to 90 minutes).

In certain embodiments, the resistive region can have any suitable cross-sectional shape. For example, the resistive region can have a round, square, or rectangular cross-section. The cross-sectional area of the resistive region (e.g., defined by a width and height in the case of a rectangular cross-section) can be varied as desired. In some embodiments, the resistive region can have a cross-sectional area of at least 0.005 $mm^2$ (e.g., at least 0.01 $mm^2$, at least 0.05 $mm^2$, at least 0.1 $mm^2$, at least 0.5 $mm^2$, at least 1.0 $mm^2$, at least 1.5 $mm^2$, at least 2.0 $mm^2$, at least 2.5 $mm^2$, at least 3.0 $mm^2$, at least 3.5 $mm^2$, at least 4.0 $mm^2$, at least 4.5 $mm^2$, at least 5.0 $mm^2$, at least 5.5 $mm^2$, at least 6.0 $mm^2$, at least 6.5 $mm^2$, at least 7.0 $mm^2$, at least 7.5 $mm^2$, at least 8.0 $mm^2$, at least 8.5 $mm^2$, at least 9.0 $mm^2$, or at least 9.5 $mm^2$). In some embodiments, the resistive region can have a cross-sectional area of 10.0 $mm^2$ or less (e.g., 9.5 $mm^2$ or less, 9.0 $mm^2$ or less, 8.5 $mm^2$ or less, 8.0 $mm^2$ or less, 7.5 $mm^2$ or less, 7.0 $mm^2$ or less, 6.5 $mm^2$ or less, 6.0 $mm^2$ or less, 5.5 $mm^2$ or less, 5.0 $mm^2$ or less, 4.5 $mm^2$ or less, 4.0 $mm^2$ or less, 3.5 $mm^2$ or less, 3.0 $mm^2$ or less, 2.5 $mm^2$ or less, 2.0 $mm^2$ or less, 1.5 $mm^2$ or less, 1.0 $mm^2$ or less, 0.5 $mm^2$ or less, 0.1 $mm^2$ or less, 0.05 $mm^2$ or less, or 0.01 $mm^2$ or less). The resistive region can have a cross-sectional area ranging from any of the minimum values described above to any of the maximum values described above. For example, the resistive region can have a cross-sectional area of from 0.005 $mm^2$ to 10.0 $mm^2$ (e.g., from 0.1 $mm^2$ to 10.0 $mm^2$, or from 1.0 $mm^2$ to 10.0 $mm^2$).

The resistive region can stretch for a varying distance (defining the length of the resistive region), for example, between a fluid inlet and an absorbent region. In some embodiments, the resistive region can have a length of at least 0.1 cm (e.g., at least 0.2 cm, at least 0.3 cm, at least 0.4 cm, at least 0.5 cm, at least 0.6 cm, at least 0.7 cm, at least 0.8 cm, at least 0.9 cm, at least 1 cm, at least 2 cm, at least 2.5 cm, at least 3 cm, at least 4 cm, at least 5 cm, at least 10 cm, at least 15 cm, at least 20 cm, or longer). In some embodiments, the resistive region can have a length of 25 cm or less (e.g., 20 cm or less, 15 cm or less, 10 cm or less, 5 cm or less, 4 cm or less, 3 cm or less, 2.5 cm or less, 2 cm or less, 1 cm or less, 0.9 cm or less, 0.8 cm or less, 0.7 cm or less, 0.6 cm or less, 0.5 cm or less, 0.4 cm or less, 0.3 cm or less, or 0.2 cm or less). The resistive region can have a length that ranges from any of the minimum dimensions to any of the maximum dimensions described above. For example, the resistive region can have a length of from 0.1 cm to 25 cm (e.g., from 0.1 cm to 10 cm, or from 0.5 cm to 5 cm). The resistive region of the pump does not have to be straight. It could, for example, be serpentine.

Likewise, the dimensions and properties of the absorbent region can be modified to select a predetermined volume of fluid to be pumped at the flow rate determined by the resistive region. The absorbent region can be fabricated in any suitable shape. For example, the absorbent region can have a circular, fan-shaped, triangular, square, or rectangular footprint. It could also have cross sections that are not rectangular. In some embodiments, the absorbent region can be sized to absorb from 1 μL to 10 mL (e.g., 10 μL to 10 mL) of fluid imbibed from the resistive region.

In some embodiments, the absorbent region can be detachably connected to the resistive region. In this way, the absorbent region can be removed (e.g., once filled with a fluid), and replaced with a fresh absorbent region (e.g., allowing the pump to imbibe another volume of fluid). If desired, detachable absorbent regions can be used, for example, to collect multiple fractions of fluid for subsequent analysis. In some embodiments, the absorbent region(s) can include an assay reagent (e.g., a reagent to facilitate the detection of an analyte of interest in the fluid imbibed from the resistive region). In other embodiments, the absorbent region(s) does not include an assay reagent.

The porous medium making up regions of the pumps described herein can be formed from any suitable porous material. Suitable porous materials can be selected in view of a number of factors, including the identity of the fluid to be transported by the pump (e.g., an aqueous fluid or an organic fluid) and the desired fluid flow rate profile to be induced by the pump. For example, the porous material must be substantially insoluble in the fluid to be transported by the pump. Pore size and characteristics (e.g. hydrophobicity, resistance to fouling) can be selected as appropriate for the individual application. For example, the porous materials can be prefabricated and cut to achieve the desired shape, they can be printed with waxes or inks that create fluidly non-conducting boundaries, or they can be introduced into molds and polymerized in place.

Porous material can be envisioned as a matrix (i.e., a skeletal portion) permeated with interconnecting pores. Generally, porous materials can be characterized by three primary characteristics with respect to their performance in a passive pump described herein: effective porosity, capillary pressure, and permeability. These are either intrinsic to the given porous material or intrinsic to the relationship of that material with the imbibing fluid. A set of primary characteristics might be useful for a given application. A given porous material—with the set of primary characteristics—can then be shaped for desired functionality.

Effective Porosity:

The effective porosity ($\varphi$) is here defined as the percent of the volume that the fluid can fill. This value can be determined by measuring the volume of fluid required to saturate a given porous material. The ratio of the volume of the fluid added to the original, total spatial volume of the porous material is the effective porosity. In an ideal material, this equals the ratio of the void volume of the porous material to the total spatial volume and is independent of the fluid used.

Capillary Pressure:

The capillary pressure ($P_c$) generated at the wetted front as a fluid is imbibing through a porous material is a function of the mean pore size of the porous material ($r_m$), the interfacial tension ($\gamma$), and the wetting angle ($\Theta$) of the imbibing fluid. The former is independent of the fluid, and the latter two are dependent on the fluid. For capillary tubes of a given radius, the capillary pressure has been described with Equation 4.

$$P_C = \frac{2\gamma\cos\theta}{r_m} \quad \text{Equation 4}$$

Permeability:

The permeability is a measure of the ability of the porous material to allow the flow of fluid. This is related to the porosity of the material, but it is also dependent on the shape and connectivity of the pores. There is an intrinsic permeability for a given porous material, and, depending on the constitution of the material, there might be anisotropy in the permeability based on the direction of flow.

The matrix, the mean pore size, and the density of pores in a porous material can be varied to achieve the desired capillary pressures for a given fluid, porosity, and permeability. By way of example, cellulose papers typically have a porosity of ~60% and a mean pore size of from 2 μm to 30 μm (depending on the particular cellulose paper). Cellulose papers can achieve permeabilities of from $10^{-12}$ $m^2$ to $10^{-16}$ $m^2$ and capillary pressures (for water imbibing into the paper) of from 1 kPa to 100 kPa.

A wide variety of porous materials are in principle suitable. Suitable porous materials are known in the art, and include, for example, porous polymer films, glass fibers, fritted glass, glass beads, aerogels, xerogels, open cell foams, and a variety of cellulosic substrates (e.g., paper, cellulose derivatives, woven cellulose materials, non-woven cellulose materials, and combinations thereof). In some embodiments, the porous materials can be flexible. For certain applications, it is desirable that the porous material can be folded, creased, or otherwise mechanically shaped to impart three-dimensional structure to the pump.

In some embodiments, the pump can be configured to drive the flow of aqueous solutions, and the porous materials can comprise a porous hydrophilic material. In certain embodiments, the porous materials can comprise a cellulosic substrate (e.g., paper, cellulose (e.g., cotton fibers), cellulose derivatives such as nitrocellulose or cellulose acetate, woven cellulose materials, non-woven cellulose materials, or a combination thereof).

In certain embodiments, the pump can be a paper-based pump (i.e., the porous materials can comprise paper). Paper is inexpensive, widely available, readily patterned, thin, lightweight, and can be disposed of with minimal environmental impact. Furthermore, a variety of grades of paper are available, permitting the selection of a paper substrate with the weight (i.e., grammage), thickness and/or rigidity and characteristics (i.e., porosity, hydrophobicity, and/or permeability), desired for the fabrication of a particular paper-based device. Suitable papers include, but are not limited to, chromatography paper, card stock, filter paper, vellum paper, printing paper, wrapping paper, ledger paper, bank paper, bond paper, blotting paper, drawing paper, fish paper, tissue paper, paper towel, wax paper, and photography paper.

In some embodiments, the porous regions of the pumps described herein (e.g., the first porous medium and the second porous medium) can be formed within a single piece of substrate material. In other embodiments, the porous regions of the pumps described herein (e.g., the first porous medium and the second porous medium) comprise separate pieces of substrate material that are in fluid contact with one another (e.g., separate pieces of substrate material that are abutted to one another). In these embodiments, the separate pieces of substrate material have the same thickness or a different thickness. In one example, the piece of substrate material forming the second porous medium can be thicker than the piece of substrate material forming the first porous material (i.e., the porous medium forming the absorbent region can be thicker than the porous medium forming the resistive region). In some cases, the piece of substrate material forming the second porous medium and the piece of substrate material forming the first porous material are not coplanar. In certain cases, the absorbent region is non-planar. For example, if desired, the absorbent region can be folded or bent into a three dimensional shape to reduce the footprint of the absorbent region (and by extension, the overall footprint of the pump).

The fluidly non-conducting boundaries within the pumps described herein can vary depending on, for example, the identity of the fluid to be transported by the pump and the methods by which the pump is manufactured. By way of example, in the case of a pump configured to drive the flow of aqueous solutions, the fluidly non-conducting boundary can comprise a hydrophobic material patterned on/within the porous material (e.g., impregnated within the porous material and/or coated on the porous material) so as to render portions of the porous material hydrophobic thereby inhibiting transport of the aqueous solution through the porous material. Examples of suitable hydrophobic materials include, for example, curable polymers, natural waxes, synthetic waxes, polymerized photoresists, alkyl ketene dimers, alkenyl succinic anhydrides, rosins, silicones, fluorinated reagents, fluoropolymers, polyolefin emulsions, resin and fatty acids, or combinations thereof.

By way of example, the fluidly non-conducting boundary can be formed by patterning the hydrophobic material (e.g., a wax) on a layer of porous material (e.g., paper). For example, an inkjet printer can be used to pattern a wax material on the porous material. Many types of wax-based solid ink are commercially available and are useful in such methods as the ink provides a visual indication of the position of the fluidly non-conducting boundary. However, it should be understood, that the wax material used to form the fluidly non-conducting boundary does not require an ink to be functional. Examples of wax materials that maybe used include polyethylene waxes, hydrocarbon amide waxes or ester waxes. Once the wax is patterned, the porous material can be heated (e.g., by placing the material on a hot plate with the wax side up at a temperature of 120° C.) and cooled to room temperature. This allows the wax material to substantially permeate the thickness of the porous material so as to form a fluidly non-conducting boundary within the porous material.

In other examples, the fluidly non-conducting boundary can comprise an air gap through which fluid cannot flow. In other examples, the fluidly non-conducting boundary can comprise a fluidly impermeable material (e.g., a polymeric membrane) abutting the porous material. In other embodiments, the porous material can be selectively modified (e.g., by covalent reaction) to form the fluidly non-conducting boundary. By way of example, in the case of a pump configured to drive the flow of aqueous solutions, regions of the porous material (e.g., regions within the paper) can be rendered hydrophobic (i.e., hydrophobically modified) by covalently modifying the porous material (e.g., the paper) with a hydrophobic agent, such as a hydrophobic silane, Optionally, the pumps described herein can further include a flow delay element to influence fluid flow though the pump. Flow delay elements can be used to begin the desired flow rate at a time after the point that fluid actually reaches the inlet region of passive pump or to temporarily delay the continuation of the flow. This level of control may be desirable if, for example, additional time is needed for sample loading or reagent incubation. Examples of flow delay elements include dissolvable solutes disposed in the fluid inlet, the resistive region, or a combination thereof, and dissolvable membranes forming a barrier to fluid flow through elements of the pump.

In some embodiments, the pump can further comprise a dissolvable solute disposed in the fluid inlet, the resistive region, or a combination thereof. For example, a varying amount of a solute can be dried in the fluid inlet and/or resistive region of the pump to delay fluid transport. Upon imbibition of a fluid such into the fluid inlet and/or resistive region, the dried solute will be dissolved, increasing the viscosity of the solution in that region of the paper according to the solute concentration. Because resistance of a given segment of porous material is proportional to the viscosity of the liquid flowing through the porous material, dissolved solute can produce a significant increase in the resistance and decrease in the volumetric flow rate in the passive pump.

Since the resistive region is typically the controller of flow rate through the pump, the flow rate increases and the pump 'turns on' once the fluid in the resistive region no longer contains the concentrated solute. When the dissolved solute reaches the absorbent region of the passive pump, the cross sectional area of the wetted front increases, decreasing the length of the viscous plug. This decreases the overall resistance to fluid flow, increasing the flow rate toward the limit established by the resistance of the resistive region for the fluid without the solute.

A variety of suitable solutes can be used. Appropriate solutes can be selected, for example, based on various design considerations including the identity of fluid flowing into the pump. While the solute can be any solid that will dissolve in the imbibing fluid, solutes that are stable in dry form under conditions of storage are preferred. For example, in some embodiments, the solute can be an organic small molecule (e.g., a sugar such as sucrose) or a polymer (e.g., polyvinyl alcohol). Varying amounts of solute can be deposited, with the amount of solute depositing influencing the magnitude of the impact on fluid flow through the pump. The solute can be deposited in the fluid inlet, the resistive region, or a combination thereof by, for example, applying a solution of the solute to the fluid inlet, the resistive region, or a combination thereof, and allowing the solvent to evaporate, leaving behind the dried solute.

In some embodiments, the pump can comprise a dissolvable membrane forming a barrier to fluid flow through elements of the pump. For example, the pump can include a dissolvable polymeric membrane (e.g., a polyvinyl alcohol membrane) disposed across the fluid flow path within the pump. For example, the pump can include a dissolvable polymeric membrane covering the fluid inlet, disposed between the fluid inlet and the resistive region, or a combination thereof to form a temporary barrier to fluid flow through elements of the pump.

The pumps can further include an evaporation barrier (e.g., an impermeable polymer membrane) enclosing the resistive region, the absorbent region, or a combination thereof. In some cases, the evaporation barrier can enclose the resistive region. In some cases, the evaporation barrier can enclose the absorbent region. In certain embodiments, the evaporation barrier can enclose both the resistive region and the absorbent region. In cases where the evaporation barrier encloses the absorbent region, the pump can further include a vent operatively coupled to the absorbent region (e.g., to allow for pressure equalization as the absorbent region fills with fluid).

If desired, the pumps described herein can be integrally formed within larger microfluidic devices to provide for control of fluids within the microfluidic device. In other cases, the pumps described herein can be modular in construction, and configured to be readily attached to an external microfluidic device. In this way, the pumps described herein can be used in a 'plug-and-play' fashion to control fluid flow in a wide range of conventional microfluidic devices. In certain embodiments, the fluid inlet can be configured to fluidly connect with a microfluidic channel. Specifically, the fluid inlet can have a geometry and construction that facilitates attachment of the pump with a microfluidic device (e.g., an external microfluidic device). By way of example, the fluid inlet can comprise a fluidly conductive region defining a path for fluid flow to the first resistive region. The fluidly conductive region can comprise, for example, a porous medium forming a path for fluid flow to the first resistive region. The fluidly conductive region can also comprise an open air-filled channel and/or a conductive material (e.g., fiberglass or glass wool) which provides a path for fluid flow to the first resistive region.

Hybrid Pumps

In some embodiments, the passive microfluidic pump can further include a second (or more) absorbent region. Such pumps are referred to herein as "hybrid pumps." Such pumps can be designed to induce more complex fluid flow rate profiles when fluidly connected to a microfluidic device. For example, in some embodiments, the pump can further comprise a second resistive region and a second absorbent region. The second absorbent region can be fluidly connected in parallel or in series to the first absorbent region.

Figure 2:
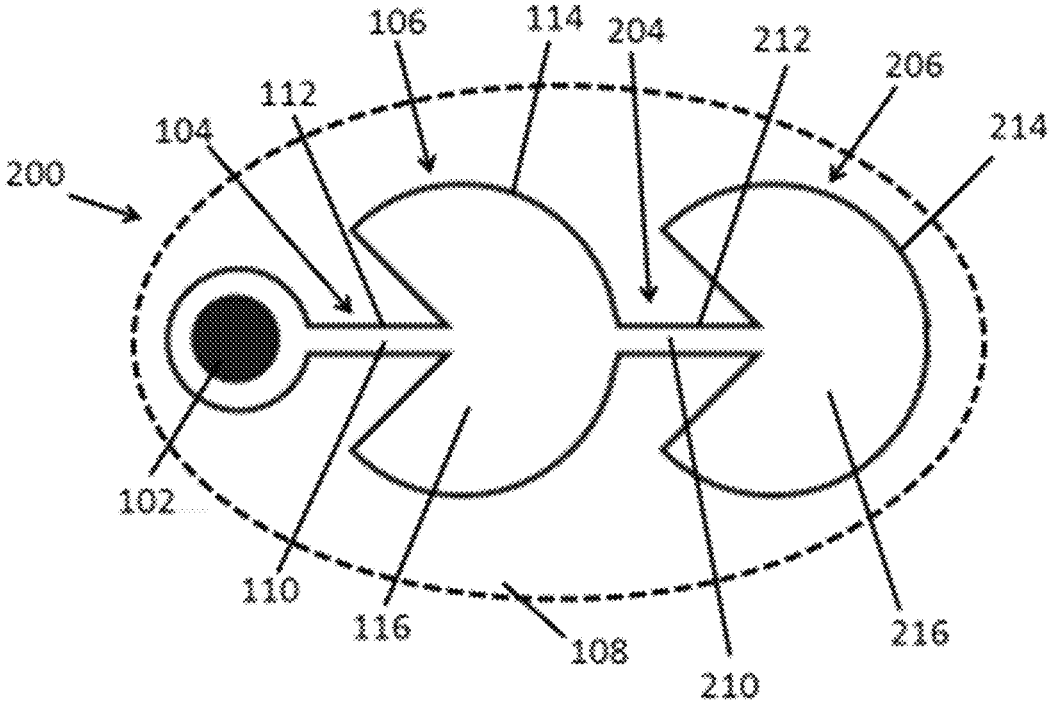
FIG. 2 is a schematic illustration of an example hybrid pump that includes a second absorbent region fluidly connected in series to a first absorbent region.

An example hybrid pump (200) including a second resistive region (204) and a second absorbent region (206) fluidly connected in series is illustrated in FIG. 2. In these embodiments, the second resistive region (204) can comprise a third porous medium (210), and a fluidly non-conducting boundary (212) defining a path for fluid flow through the third porous medium from the first absorbent region (106) to the second absorbent region (206); and the second absorbent region (206) can comprise a fluidly non-conducting boundary (214) defining a volume of a fourth porous medium (216) sized to absorb a predetermined volume of fluid imbibed from the second resistive region. In certain cases, the pump can further include flow delay element(s) to influence fluid flow though the pump. For example, in some embodiments, the pump can further comprise a dissolvable solute disposed in the second resistive region. In some embodiments, the pump can further comprise a dissolvable membrane forming a barrier to fluid flow from the first absorbent region to the second resistive region.

Figure 3:
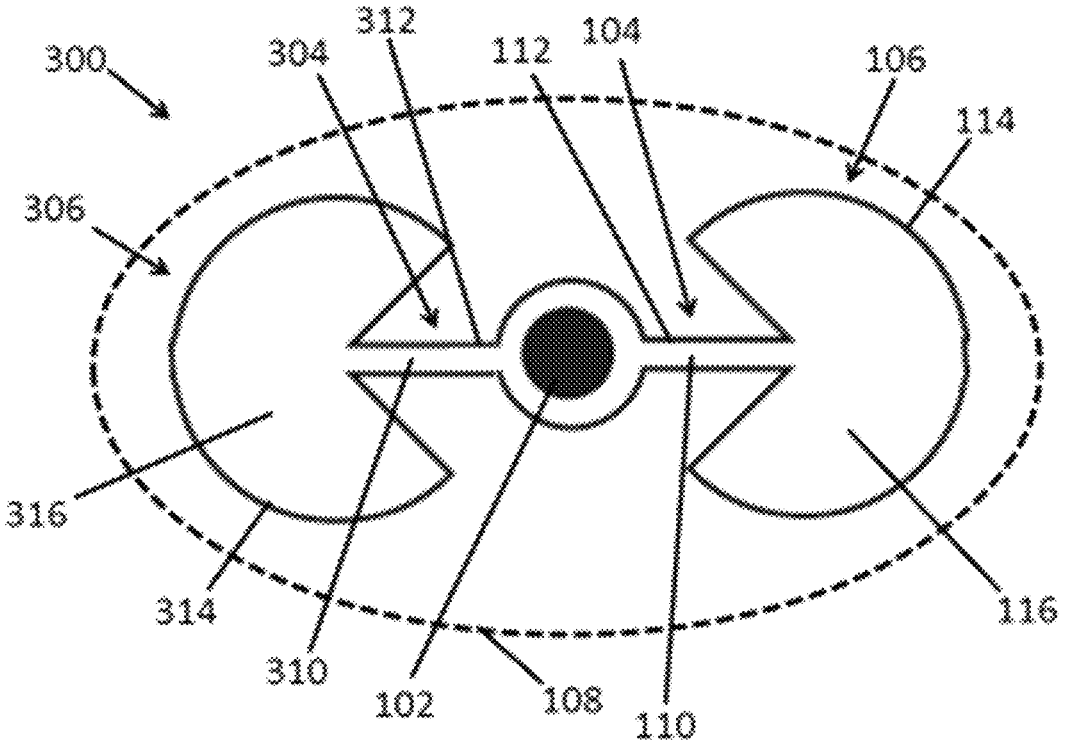
FIG. 3 is a schematic illustration of an example hybrid pump that includes a second absorbent region fluidly connected in parallel to a first absorbent region.

An example hybrid pump (300) including a second resistive region (304) and a second absorbent region (306) fluidly connected in parallel is illustrated in FIG. 3. In these embodiments, the second resistive region (304) can comprise a third porous medium (310), and a fluidly non-conducting boundary (312) defining a path for fluid flow through the third porous medium from the fluid inlet (102) to the second absorbent region (306), and the second absorbent region (306) can comprise a fluidly non-conducting boundary (314) defining a volume of a fourth porous medium (316) sized to absorb a predetermined volume of fluid imbibed from the second resistive region. In certain cases, the pump can further include flow delay element(s) to influence fluid flow though the pump. For example, in some embodiments, the pump can further comprise a dissolvable solute disposed in the second resistive region. In some embodiments, the pump can further comprise a dissolvable membrane forming a barrier to fluid flow from the fluid inlet into the second resistive region.

In some embodiments, the hybrid pump can include three or more absorbent regions. For example, the hybrid pump can include three or more absorbent regions fluidly connected in parallel via resistive regions. The hybrid pump can also include three or more absorbent regions fluidly connected in series via resistive regions. In some cases, the hybrid pump can include absorbent regions fluidly connected both in parallel and in series. For example, in some embodiments, the hybrid pump can comprise two or more absorbent regions fluidly connected in parallel via resistive regions, and two or more absorbent regions fluidly connected in series via resistive regions.

Compound Pumps

Also provided herein are compound pumps comprising a plurality of fluidly connected pumps or hybrid pumps described herein. Such pumps can be designed to induce more complex fluid flow rate profiles (programmable flow rates) when fluidly connected to a microfluidic device. The plurality of the pumps can be fluidly connected in parallel, in series, or with pumps fluidly connected both in parallel and in series. In some embodiments, the plurality of the pumps can comprise two or more pumps fluidly connected in series. In some embodiments, the plurality of the pumps can comprise two or more pumps fluidly connected in parallel. In certain embodiments, the plurality of the pumps can comprise two or more pumps fluidly connected in series and two or more pumps fluidly connected in parallel.

The plurality of pumps can be fluidly connected in any suitable fashion. In certain embodiments, the plurality of the pumps are stacked in parallel planes. Optionally, compound pumps can further include flow delay element(s) to influence fluid flow though the compound pump (e.g., into at least one of the plurality of fluidly connected pumps). For example, in some embodiments, the pump can further comprise a dissolvable solute disposed in the fluid inlet of a pump in the compound pump, the resistive region of the pump in the compound pump, or a combination thereof. In some embodiments, the pump can further comprise a dissolvable membrane forming a barrier to fluid flow between two of the plurality of the pumps in the compound pump.

Microfluidic Devices

Also provided are microfluidic devices that include one or more of the passive pumps described herein. Example microfluidic devices can include a microfluidic channel fluidly connecting a fluid inlet to a fluid outlet, and a pump described herein (e.g., a pump, hybrid pump, and/or compound pump) fluidly connected to the fluid outlet of the microfluidic channel (e.g., such that the pump induces fluid flow through the microfluidic channel when the fluid inlet is contacted with fluid). In some cases, the fluid inlet of the pump can be in direct contact with the fluid outlet of the microfluidic channel.

In certain embodiments, the pump can be configured to drive fluid flow through the microfluidic channel at a substantially continuous flow rate for a period of at least 0.1 minutes (e.g., at least 0.5 minutes, at least 1 minutes, at least 5 minutes, at least 10 minutes, at least 30 minutes, at least 60 minutes, or longer). In other embodiments, the pump can be configured to drive fluid flow through the microfluidic channel at a variable flow rate for a period of at least 10 minutes (e.g., at least 30 minutes, at least 60 minutes, or longer). The variable flow rate can comprise, for example, a stepwise increasing flow rate or a stepwise decreasing flow rate.

Methods of Use

Also provided are methods of using the pumps (including the hybrid pumps and compound pumps) described herein. The pumps described herein can be used to induce fluid flow through an attached microfluidic device (e.g., to achieve a controlled flow rate for a set volume, and/or to achieve multiple predetermined flow rates through the device). Accordingly, also provided are methods for inducing fluid flow through a microfluidic device that comprise fluidly connecting a pump described herein to a fluid outlet of the microfluidic device; and contacting a fluid inlet of the microfluidic device with a fluid. In some embodiments, the pump can be directly connected to the fluid outlet of the microfluidic device.

In certain embodiments, the pump can be configured to drive fluid flow through the microfluidic channel at a substantially continuous flow rate for a period of at least 0.1 minutes (e.g., at least 0.5 minutes, at least 1 minutes, at least 5 minutes, at least 10 minutes, at least 30 minutes, at least 60 minutes, or longer). In other embodiments, the pump can be configured to drive fluid flow through the microfluidic channel at a variable flow rate for a period of at least 10 minutes (e.g., at least 30 minutes, at least 60 minutes, or longer). The variable flow rate can comprise, for example, a stepwise increasing flow rate or a stepwise decreasing flow rate.

The pumps (including the hybrid pumps and compound pumps described herein) can also be used in process control applications. For example, pumps described herein can be used to determine the fluidic resistance of microfluidic channels, to measure the height of microfluidic channels, to quantify the properties (e.g. the permeability) of a porous material such as paper, and/or to quantify the properties (e.g., the viscosity) of an unknown fluid.

Methods of Making Compound Pumps

Given the modular nature of the pumps described herein, individual modular pumps can be readily assembled to form a compound pump to provide a predetermined fluid flow rate within a microfluidic channel. Accordingly, also provided are methods of assembling passive compound pumps configured to provide a predetermined fluid flow rate within a microfluidic channel. These methods can comprise fluidly connecting one or more pumps described herein (referred to in this context as a "pump subunit") shaped to induce a particular fluid flow rate upon contact with a fluid to a fluid inlet to form the passive compound pump. Each pump subunit can comprise a resistive region comprising a first porous medium, and a fluidly non-conducting boundary defining a path for fluid flow through the first porous medium from the fluid inlet to the absorbent region, and an absorbent region comprising a fluidly non-conducting boundary defining a volume of a second porous medium sized to absorb a predetermined volume of fluid imbibed from the resistive region. Optionally, each pump subunit can be enclosed within an evaporation barrier.

In some embodiments, methods of assembling a passive compound pump can comprise fluidly connecting two or more pump subunits. In some embodiments, methods can comprise fluidly connecting two or more pump subunits in series. In some embodiments, methods can comprise fluidly connecting two or more pump subunits in parallel. In certain embodiments, methods can comprise fluidly connecting two or more pump subunits in series, and fluidly connecting two or more pump subunits in parallel. In certain embodiments, fluidly connecting the pump subunits can comprise stacking the pump subunits to form the fluid inlet. In these embodiments, the fluid inlet can comprise a fluidly conductive region extending through the pump subunits in the stack, and defining a path for fluid flow to the first resistive region of each of the pump subunits. The fluidly conductive region can comprise, for example, a porous medium forming a path for fluid flow. The fluidly conductive region can also comprise an open air-filled channel and/or a conductive material (e.g., fiberglass or glass wool) which provides a path for fluid flow. In some embodiments, methods can further comprise positioning a dissolvable membrane between pump subunits in the stack (e.g., transecting the fluid inlet) so as to form a barrier to fluid flow between pump subunits in the compound pump.

By way of non-limiting illustration, examples of certain embodiments of the present disclosure are given below.

EXAMPLES

Materials and Methods

As discussed above, the absorbent region and resistive region of the passive pumps described herein are formed from porous materials. The porous materials can be shaped to provide the flow rates and volumes of fluid flow desired for a particular application. The fluid inlet can be composed of the same porous material or other materials, both porous and non-porous. These materials can be selected to facilitate fluid connection of the pump to an external fluid source (e.g., a microfluidic device). The fluid inlet can in principle be adapted to connect the pump to any fluid source from which or through which one wishes to control the fluid flow rate, including but not limited to microfluidic channels or tubing. Pumps including a plurality of absorbent regions (referred to herein as "hybrid pumps") as well as compound pumps (multi-pump assemblies including a plurality of fluidly connected pumps and/or hybrid pumps) were also prepared. As demonstrated below, hybrid pumps and compound pumps can be used to pump fluid at a variety of pre-programmed flow rates that are more complex than a simple continuous flow at a single flow rate for a set time.

For proof-of-principle experiments, chromatography paper (e.g., Whatman #1 chromatography paper), filter papers, and commercially prepared nitrocellulose membranes were used as porous materials for the fabrication of pump components. While the examples below reference paper, it will be understood that other porous materials (as discussed above) can also be used to fabricate the pumps described herein. Laser cutting was performed on a VLS3.60 laser cutting platform from Universal Laser Systems; however, other methods of shaping porous materials are also suitable. For convenience, lamination of the porous material was performed using Scotch thermal laminating pouches (letter size and photo size) with a Scotch thermal laminator was used (2 roller, maximum width 9"). The laminator settings were changed (3 mil vs 5 mil) depending on the requirements for the thermal pouch used. The cutting plotter that was used was from Graphtec (Model # CE6000-40). Clear, biaxially-oriented polystyrene films (125 μm) were from Goodfellow, Inc. Thin, double-sided adhesives were used from 3M. Single-sided Scotch tape was from 3M. Other methods for lamination, cutting and attachments are also applicable.

The imbibing fluid used in these experiments was deionized water that had been spiked with blue food coloring (Acid Blue 9, Great Value Assorted Food Coloring) to aid in the visual contrast at the wetted front and/or at the lagging edge of the fluid. A wide variety of imbibing fluids can be used including clinical fluids, environmental water samples, cell culture medium, beverages, food homogenates, and aqueous or organic solvents containing a wide variety of solutes or particles. A wide variety of suitable papers, porous materials, coating materials, machinery, and imbibing fluids can be combined for use in other embodiments.

Modeled Flow Through Segments of Porous Material

While not a perfect analogy, fluid flow through pumps can be modeled in an analogous manner to circuits, where the volumetric flow rate (Q) through a given component is equal to the pressure difference (ΔP) across the component divided by its resistance to flow ($R_t$) (Equation 1). In the case of paper and many other porous materials, there exists a capillary pressure at the wetted front due to the surface tension of the fluid imbibing through the pores of the porous material. This capillary pressure acts on the fluid to pull it toward unwetted regions of the porous material (i.e., imbibition). The interaction between the fluid and matrix of the porous material behind the wetted front impedes flow. Therefore, as the length of the fully wetted segment increases, the resistance does as well. For a given capillary pressure and an increasing resistance, the flow rate decreases over time $$Q = \frac{\Delta P}{R_t} \quad \text{Equation 1}$$

Figure 4A:
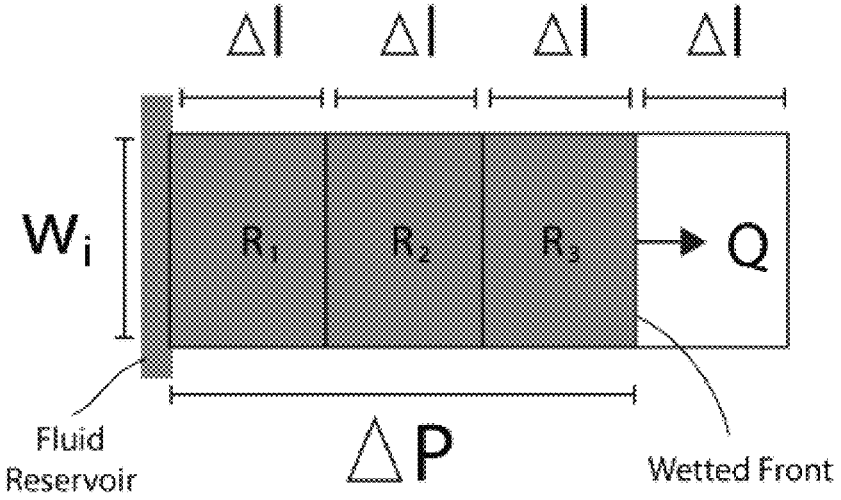
FIG. 4A illustrates a schematic representation of the stepwise approach of the one-dimensional numerical methods model to predict fluid flow through a rectangular strip of a porous material with known intrinsic properties.

As shown in FIG. 4A, we can model this flow in a 1D model by dividing the entire rectangular segment into individual steps along the direction of fluid flow and approximating the resistance and volumetric capacity of each step. This first-order model assumes that the porous material is fully saturated behind the wetted front and predicts the location of the wetted front as a function of time for a set of fluids and porous materials. The resistance $R_p$ of fully wetted rectangular segments has been described with the Equation 2, where $L_p$, $W_p$, and $h_p$ are the length, width, and height of the rectangular segment. The values μ and K are the viscosity of the fluid and the permeability to flow, respectively. The volumetric capacity (effective void volume) $V_c$ of a given segment can be described by Equation 3, and φ is the effective porosity of the paper or other material.

$$R_p = \frac{\mu L_p}{\kappa w_p h_p} \quad \text{Equation 2}$$

$$V_c = \phi h_p L_p w_p \quad \text{Equation 3}$$

Figure 4B:
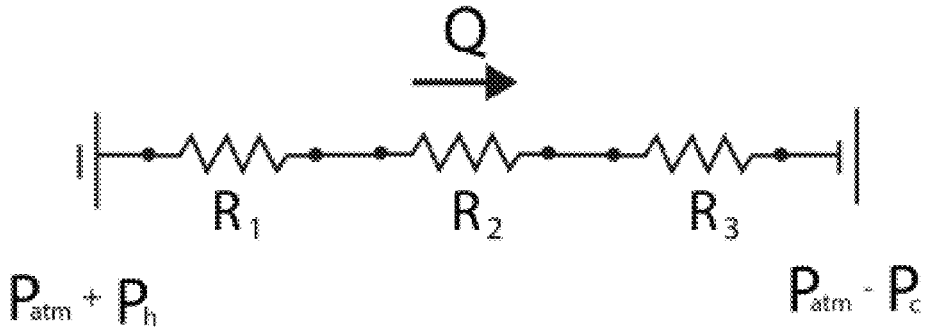
FIG. 4B illustrates a schematic representation of the corresponding circuit of the stepwise approach shown in FIG. 4A.
Figure 4C:
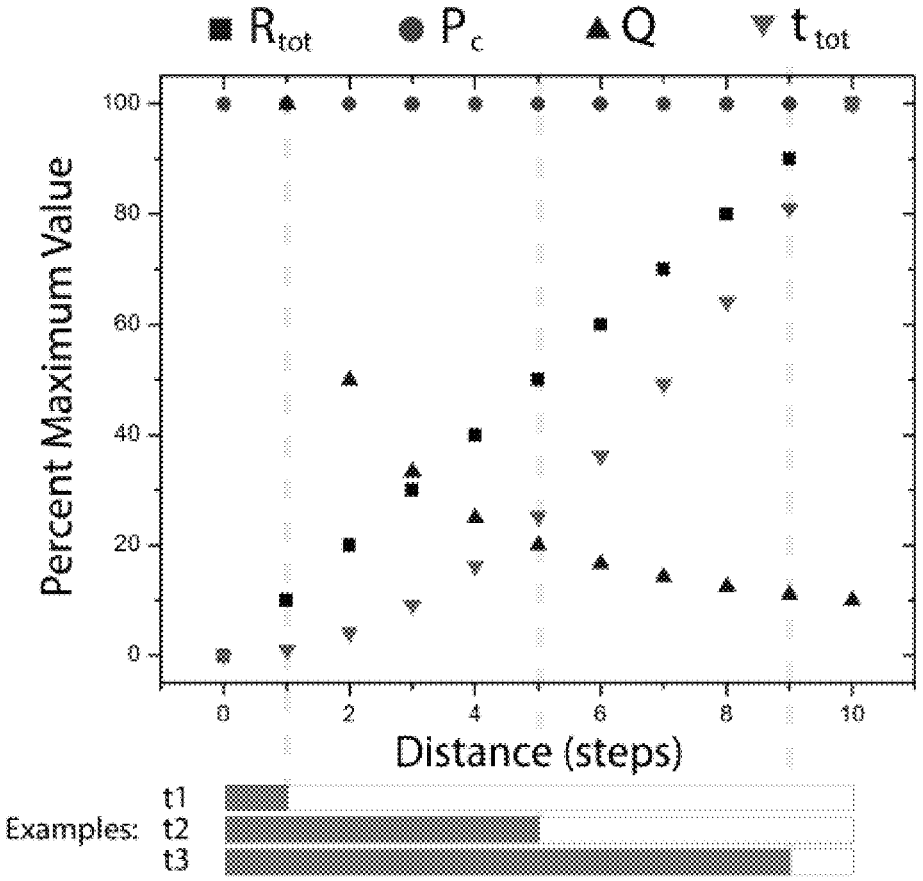
FIG. 4C illustrates an exemplary result of the calculated resistance $R_{tot}$, volumetric flow rate Q, and time $t_{tot}$ for each step along the direction of propagation of the approach shown in FIG. 4A.
Figure 5:
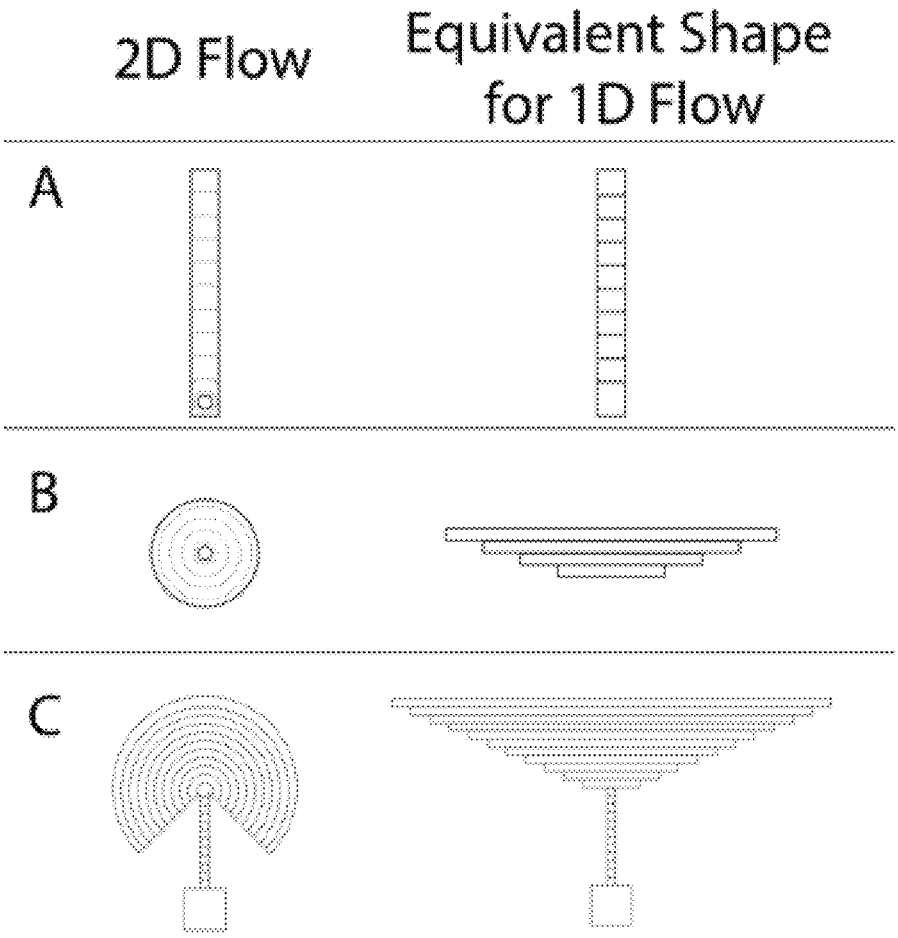
FIG. 5 illustrates exemplary shaped assemblies and the shapes of the liquid front expected of each shape (left column) and a schematic of the effective width of the wetted front as a function of the wetted front position (right column).

The total resistance of the paper up to the wetted front can be approximated by adding the resistance of each segment of the wetted paper in series. In addition, the volumetric capacity of the first segment that is not yet wetted can be approximated. The volumetric flow rate at a given position of the wetted front can be calculated by using the calculated pressure difference and resistance between the fluid source and the wetted front, as described with Equation 1 and shown in FIG. 4B. The pressure difference (ΔP) includes the capillary pressure (modeled here as a constant for the given paper and fluid) as well as any additional pressure source (hydrostatic pressures, other Laplace pressures, etc.). The time that the front will effectively be at a given location can be calculated by determining the time to fill the volumetric capacity of the next segment using the calculated volumetric flow rate. The volumetric flow rate (Q), total resistance ($R_t$), and pressure are then each functions of the 1D wetted front position, as shown in FIG. 4C. This model shows that it predicts a characteristic curve of Washburn flow for a given rectangular strip of paper as shown in FIG. 4C. FIG. 5 shows how the imbibition through rectangular and non-rectangular shapes can be represented as an effective width of the wetted front as a function of the wetted front position for the 1D model.

Methods of Fabricating Passive Pumps

Figure 6:
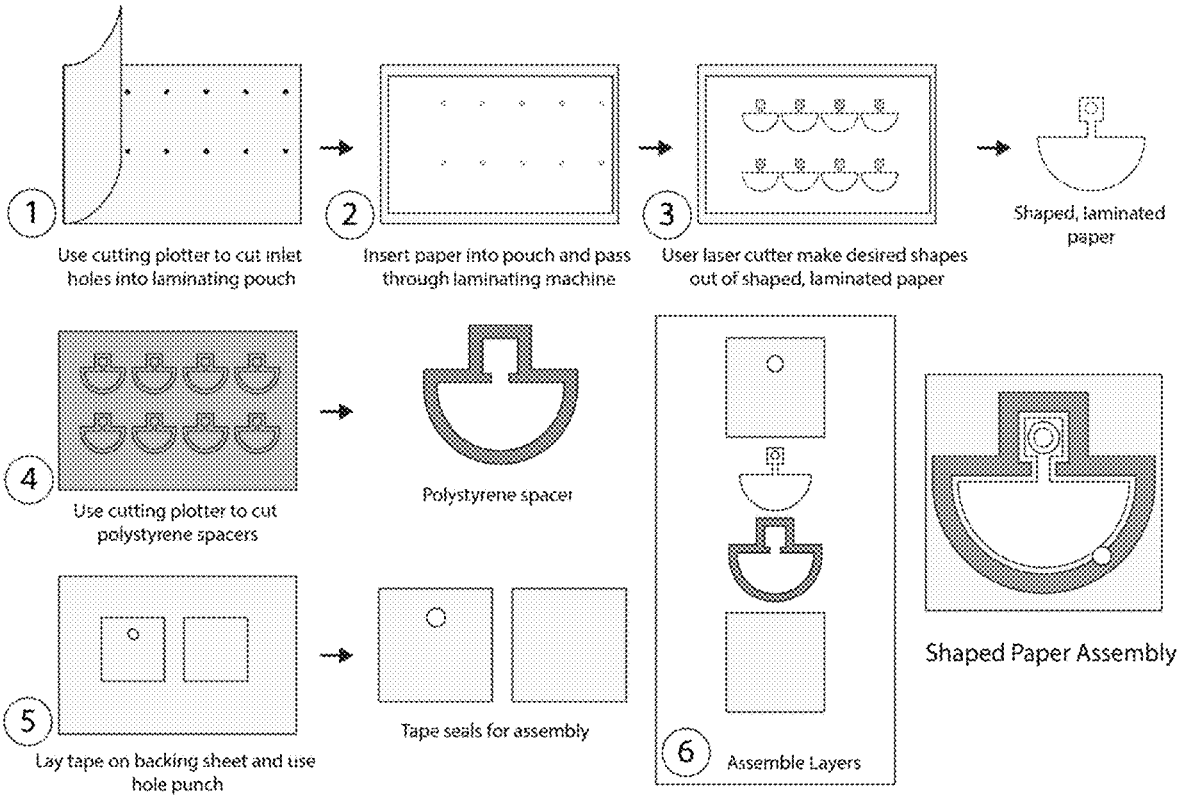
FIG. 6 illustrates a schematic of the steps of fabrication of the shaped paper assembly according to one embodiment.
Figure 7:
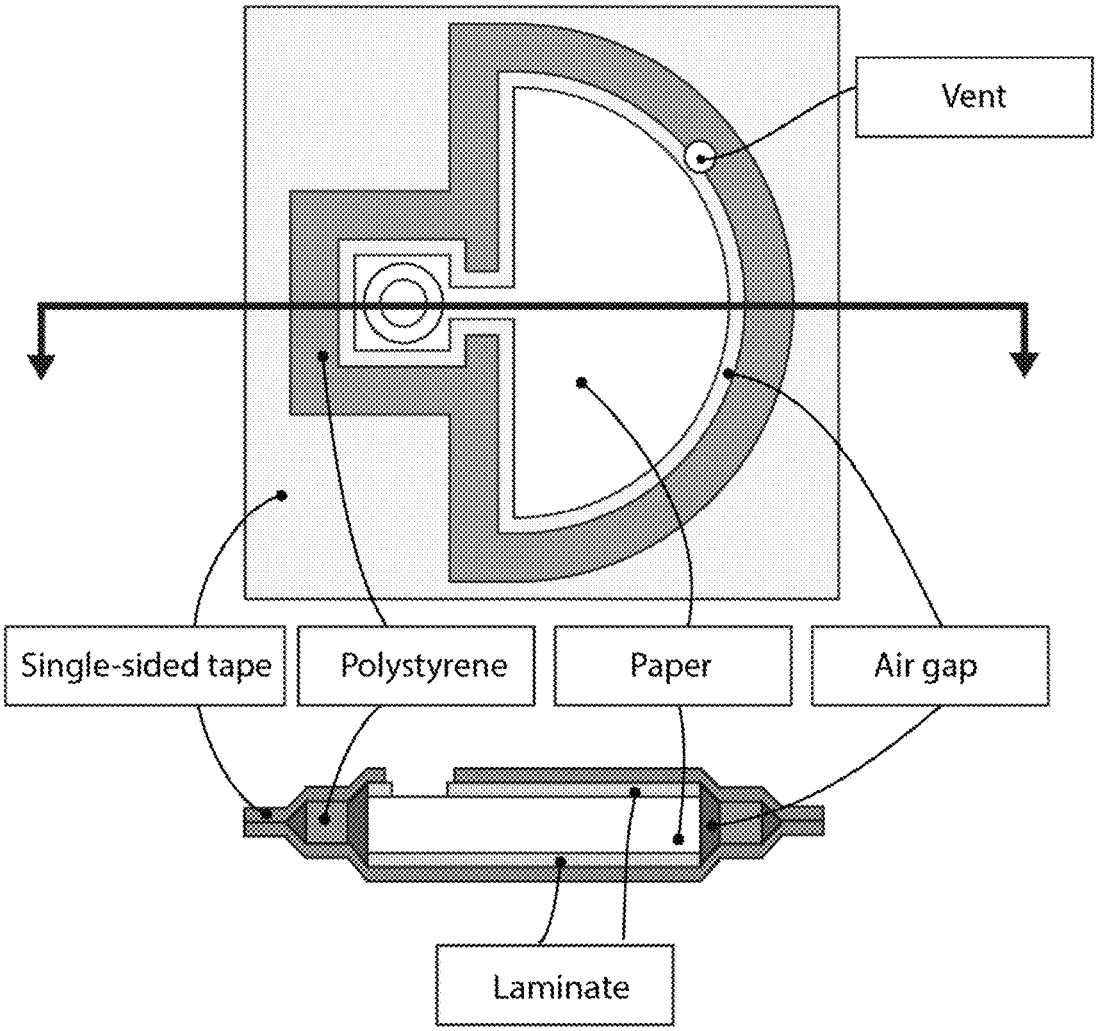
FIG. 7 illustrates a schematic of the final shaped paper assembly shown in FIG. 3 using air gaps as the fluidly nonconducting boundary.

FIG. 6 illustrates an exemplary protocol for making a shaped, laminated paper pump, and FIG. 7 illustrates an example pump assembled according to the protocol outlined in FIG. 6. First, holes (e.g., 3 mm inner diameter (ID)) are cut into one face of a laminating pouch using a cutting plotter. These holes serve to provide access to the inlet regions for the final assembly. Rectangular sheets of Whatman Chromatography 1 paper are sized for the given laminating pouch, placed in the pouch and run through a laminating machine (e.g., using the 5 mil setting). After allowing the laminated sheet to cool, the laser cutter is used to cut the designed shapes out of these laminated sheets. The paper is positioned in the cutter so that the actual center of the inlet region matches the intended location of the inlet region for the shape that is to be cut. Then, the cut is performed using settings that minimize any charring of the paper. At this stage, the edges of the paper of these laminated shapes are open to the atmosphere.

To minimize evaporation and still provide an escape for air as the fluid imbibes, certain modifications can be made to the assembly. For example, an air gap can be maintained around the boundary of the paper. The paper in the assembly, including the air gap, can be covered from the external atmosphere to minimize evaporation effects, with only a small vent in this seal to allow for pressure equilibration. Other methods of preventing evaporation from the absorbent and resistive regions can also be used. The need for venting can likewise depend on the specific device design and application.

Figure 8:
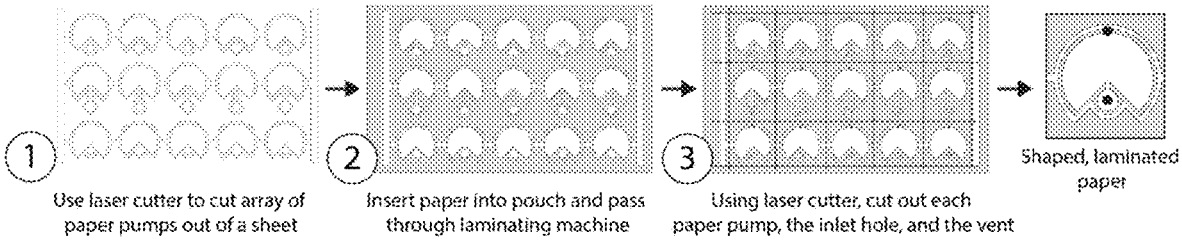
FIG. 8 illustrates a schematic of the steps for fabrication of multiple passive pumps according to another embodiment.

FIG. 8 illustrates an alternative method for making a shaped, laminated paper pumps. The protocol outlined in FIG. 8 involves three steps, as opposed to the six steps described above in relation to the protocol shown in FIG. 6. As shown in step 1, a laser cutter is used to cut an array of pumps out of a sheet of paper or other porous medium. The pumps in the array are coupled together to allow the pumps to be moved together and maintain their spacing relative to each other. In step 2, the cut paper is in inserted into a pouch (or between two sheets) of lamination material, and the lamination material is passed through a lamination machine. Then, in step 3, an inlet hole and a vent hole are cut through each pump, and grid lines dividing each pump are cut.

During step 1, a halo of paper is defined around and spaced apart from the absorbent region and the resistive region to provide the air gap around the porous material that forms a fluidly non-conducting boundary. When the vent opening is cut, the portion of the halo that is coupled to the absorbent region is removed, which prevents the halo from being in fluid communication with the absorbent region of the pump. The air gap is in communication with the vent opening. As shown in FIG. 8, the pumps cut out of the single sheet of porous medium material may have absorbent regions having the same or different areas and resistive regions having the same or different areas and/or lengths.

Methods of Measuring Flow Rate

Flow studies were performed by adding fluid (e.g., 45 μL) at the inlet region, and tracking the imbibition as a function of time. The fluid used was deionized water with Acid Blue 9 in this example. Time-lapse videos of imbibition into various shapes were captured with an iPhone, and a stopwatch was included in the video to serve as an absolute measure of time. Individual frames were analyzed using ImageJ (http://imagej.nih.gov/ij/) to measure the number of pixels from the center of the inlet region to the wetted front at different time points. The pixels were converted to millimeters by knowing the length of the associated shape. For each shape, the actual position was compared with the modeled position versus time. In another method, the flow rate profile was determined for a given pump by attaching the pump to a microfluidic channel and/or tubing and tracking the position of the lagging edge of the fluid upstream.

It will be readily understood by a skilled artisan that tracking the imbibition of the fluid through the porous medium can be accomplished using a variety of, for example, optical or electrochemical approaches, to include, without limitation, the use of a dye in the porous medium instead of in the fluid (as discussed above) and the use of electrodes within the porous medium that will transmit a signal upon interaction with the fluid.

Example Passive Pumps

Assemblies of shaped porous materials can be used as passive pumps for microfluidic devices. The passive pump requires no external power or tubing to connect it to the microfluidic device. If desired, passive pump assemblies can be fabricated on and/or integrated within a microfluidic device to provide for fluid control. Alternatively, the pump can be configured to attach to a separate microfluidic device. For example, the pump can be constructed in a modular fashion (e.g., as a single disposable unit) which can then be fluidly connected to a microfluidic device. In these cases, spent pumps can be replaced with fresh pumps, for example, if pumping over long periods (e.g., several days) is required or sequential samples are collected for further analysis over time. The pump can be fabricated to be disposable, biodegradable, and/or combustible. In addition, the pumps can be designed to occupy a very small footprint.

Figure 9:
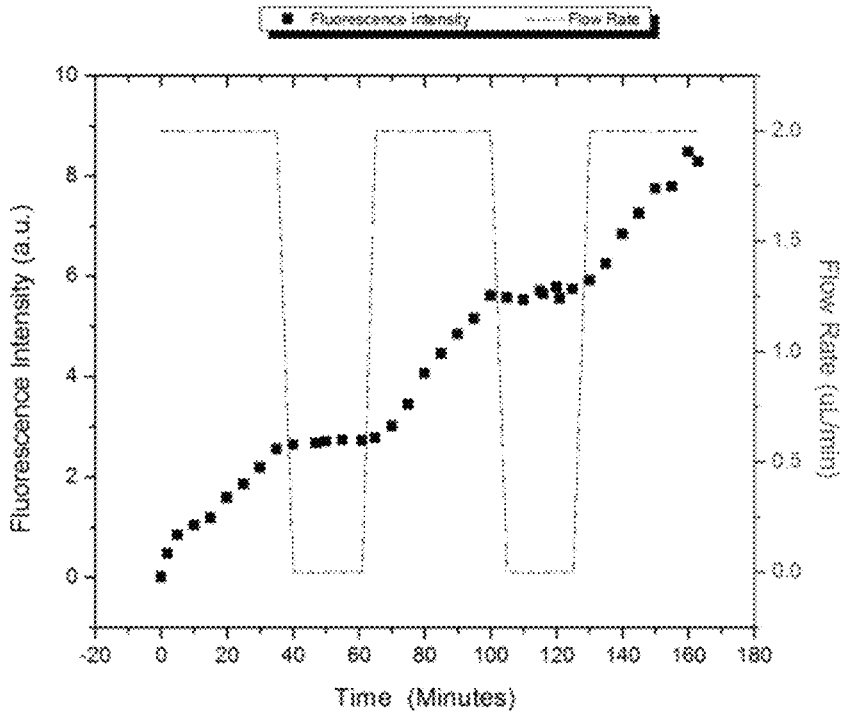
FIG. 9 illustrates experimental data of a point-of-care test with varying flow rates (e.g., by using a syringe pump). The fluorescent intensity is of the target binding to spots of the microarray at the bottom of the microchannel. The results show that an increased flow rate increases the rate of binding (slope of fluorescent intensity versus time) and that sustained flow increases the sensitivity of the diagnostic test.

Depending on design, the pumps can provide flow rates in the nL/min to μL/min range and can be programmed to stop flow after a fixed volume of liquid has been pumped. These programmable pumps are low-cost and can be used in a 'plug-and-play' fashion with a wide range of conventional microfluidic devices. As an example, FIG. 9 illustrates experimental data collected for an example point-of-care fluorescence-based assay performed at varying flow rates provided using a conventional syringe pump. Fluorescence intensity was generated by the target-binding spots of an antibody microarray immobilized on a waveguide at the bottom of a microchannel. As shown in FIG. 9, an increased flow rate increases the rate of binding (slope of fluorescent intensity versus time). Further, a sustained flow increases the sensitivity of the diagnostic test. The pumps described here can be integrated with the microfluidic channels in the point of care test to generate the same type of flow as the syringe pump and produce the increase the sensitivity without the power requirement, additional expense, and technical complexity.

Example 1

Single Pump to Generate Steady Flow Rate for Microfluidic Device

Figure 10A:
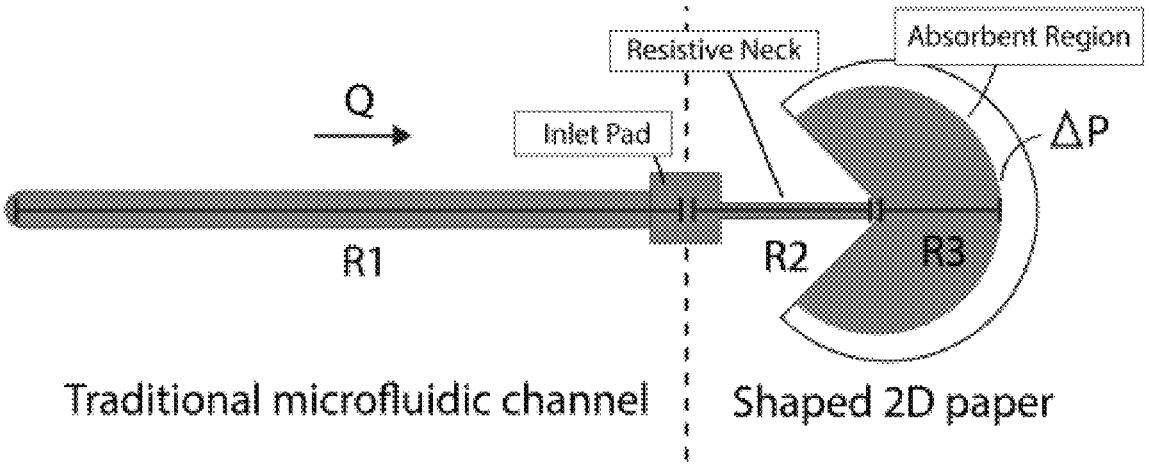
FIG. 10A illustrates a schematic of a passive pump attached to a traditional microfluidic channel according to one embodiment.
Figure 10B:
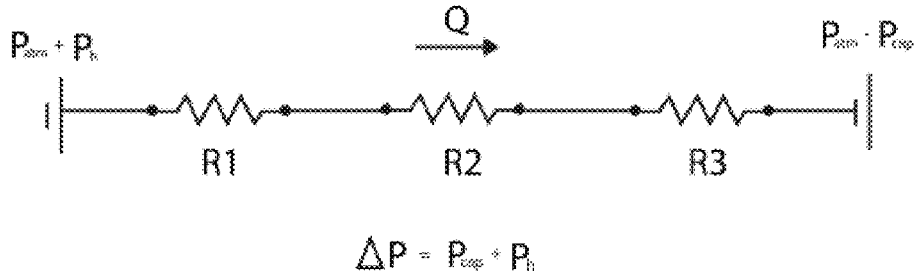
FIG. 10B illustrates a schematic of the analogous resistance electrical circuit.
Figure 10C:
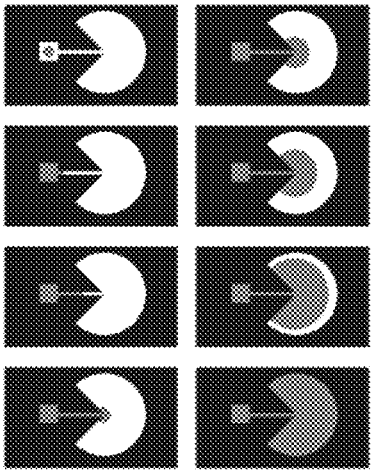
FIG. 10C illustrates the expected flow of fluid into a passive pump, wherein the inlet is first wetted, then the fluid passes down the resistive neck and finally into the absorbent region.

The passive pumps can be connected to the outlet of the microfluidic channel. The negative capillary pressure of the fluid in the porous material can cause a pressure differential that drives fluid flow from the reservoir at the inlet of the microchannel, through the microchannel, and into the pump. The passive pumps can be formed out of any shaped porous material, such as paper, can include up to three defined regions: (a) a fluid inlet (e.g., an inlet region) to connect to the outlet of the microchannel, (b) a resistive region (e.g., a resistive neck), and (c) an absorbent region. The inlet region (a) is designed to provide for a reproducible connection to the outlet of a microfluidic channel. For a given porous material, the size of the resistive neck (b) controls the flow rate. The resistance of the neck can be increased by increasing the length of the neck and/or decreasing the cross-sectional area of the neck. For a neck with a rectangular cross-section, this can be done by decreasing the thickness of the neck, and/or decreasing the width of the neck. The void volume of the absorbent region (c) controls the volume that can be absorbed. The time that the pump functions corresponds to the volume that can be absorbed and the flow rate defined by the neck. In FIG. 10, a circular footprint used for the absorbent region, but other shapes including but not limited to triangles or radial segments are also possible. An example passive pump attached to a traditional microfluidic channel is shown in FIG. 10A, and the analogous electrical circuit for the pump is shown in FIG. 10B. The expected flow of fluid into the pump is shown in FIG. 10C, wherein the inlet region is first wetted, then the fluid passes down the resistive neck and finally into the absorbent region.

Typically, the flow rate of these passive pumps can be programmed to be from below 1 nL/min to greater than 100 μL/min. To achieve the lowest flow rates using this basic pump design, the resistance of the neck can be increased to high levels. As long as the resistance of this neck is higher than the expected resistance of the microchannel, a specific pump design will generate the same flow rate in a variety of microchannels of different geometry. This effectively makes it a 'plug and play' pump for a known fluid. In these cases, the pump is analogous to an ideal current source.

To achieve maximum flow rates using the basic pump design, the resistance of the neck can be minimized. With a minimal resistive region between the microfluidic channel and the absorbent region, the volumetric flow rate of the passive pump could be dependent on the resistance of the microchannel.

Figure 11:
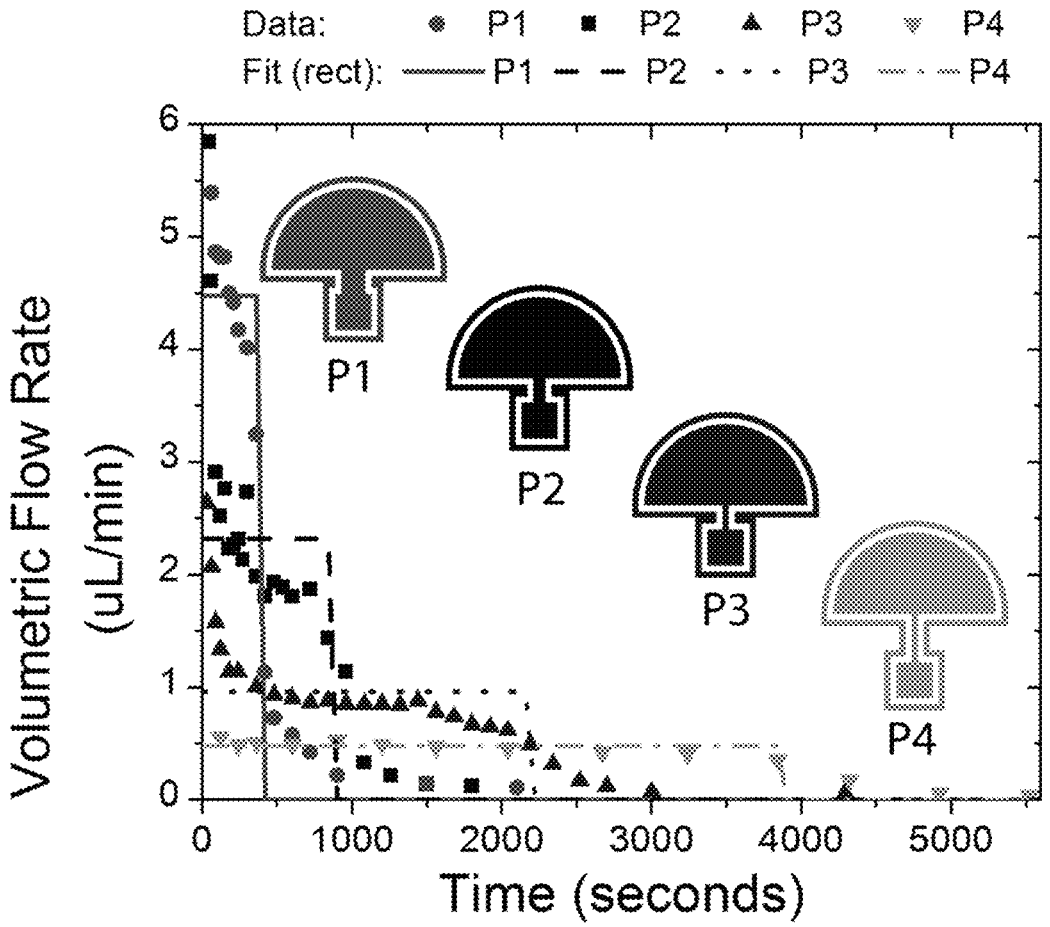
FIG. 11 illustrates four passive pumps (P1, P2, P3, and P4) made from the same porous material with different neck resistances but the same volumetric capacity in the absorbent region. Each of these pumps has a similar volumetric capacity because the absorbent regions are all the same size.

The effect that the neck resistance has on the volumetric flow rate can be seen in FIG. 11. Experimentally, four passive pumps (P1, P2, P3, and P4) with different neck resistances were fabricated using laminated Whatman #1 chromatography paper. The volumetric flow rate profile was measured for each of these pumps (4.5 μL/min, 2.3 μL/min, 1 μL/min, and 0.5 μL/min, respectively). Each of these pumps has a similar volumetric capacity because the absorbent regions are all the same size. Because each pump holds the same volume (same area under the flow rate profile), they pumped for varying lengths of time (with the length of time increasing with neck resistance. Because the resistance of the neck was much greater than the resistance of the absorbent region, the volumetric flow rate stayed effectively constant once the fluid front reached the absorbent region.

Figure 12:
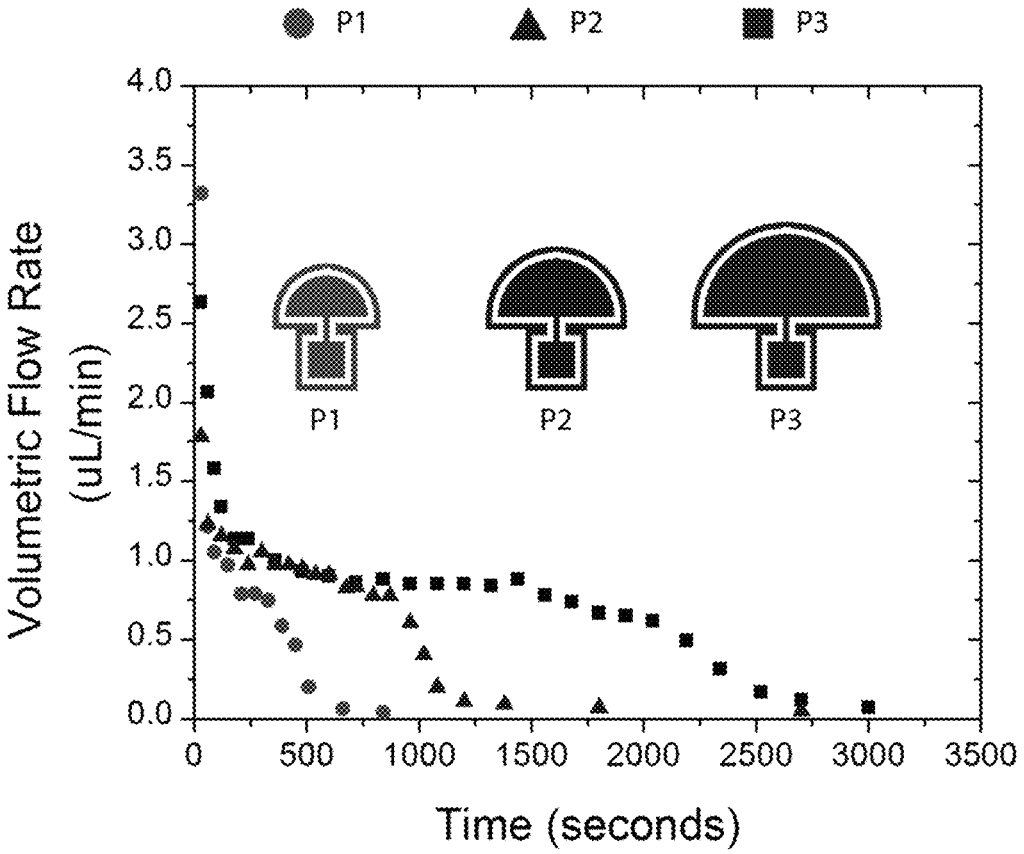
FIG. 12 illustrates three passive pumps (P1, P2, and P3) made from the same porous material but with absorbent regions of varying size. Each of these pumps has a similar resistance of the neck because the resistive necks are all the same dimensions.

The effect that varying the area of the absorbent region has on the volumetric flow rate can be seen in FIG. 12. Each of these pumps has a similar resistance of the neck because the resistive necks are all the same dimensions. The resistance of the neck is still much greater than the resistance of the absorbent region. Therefore, once the fluid front reaches the absorbent region, the volumetric flow rate stays effectively constant. FIG. 12 shows that the flow rate is effectively the same for each pump, but the volume that each pump absorbs (area under the flow rate profile) and the corresponding time that it pumps increases for increasing areas of the absorbent region. Experimentally, passive pumps similar to those shown in FIG. 12 were fabricated using laminated Whatman #1 chromatography paper, and each pump had the same resistor size.

Figure 13A:
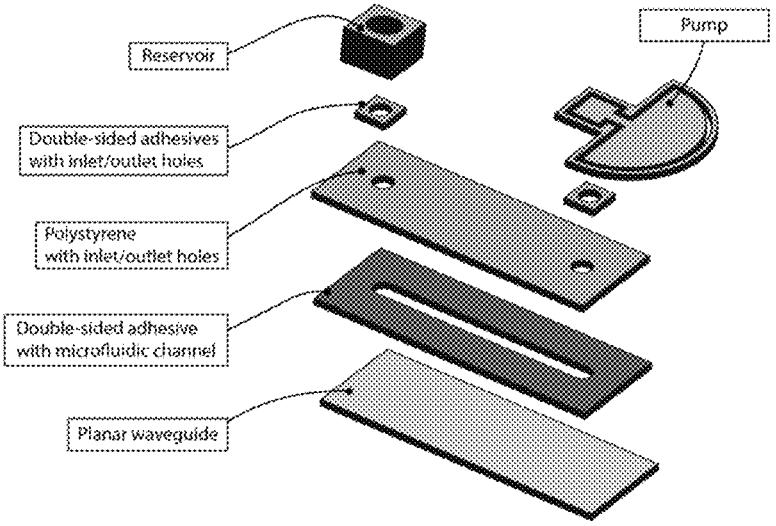
FIGS. 13A and 13B illustrate a schematic of a passive pump being integrated into an assembly for a point-of-care diagnostic test.
Figure 13B:
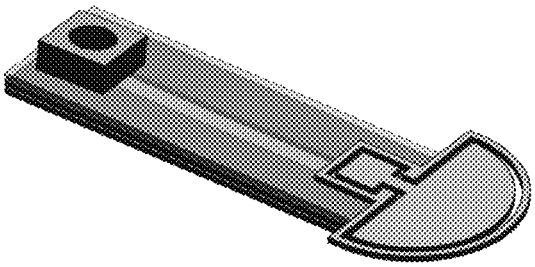

FIGS. 13A and 13B illustrate a schematic showing how a passive pump could be included in a point-of-care diagnostic test. FIG. 13A shows an exploded view of the final diagnostic test shown in FIG. 13B. From bottom to top, there exists a planar waveguide on which capture reagents can be spotted, a layer of a double sided adhesive with an opening to serve as the microfluidic channel, a film to serve as the top of the microfluidic channel with inlet and outlet holes, double-sided adhesive with holes to connect the inlet and outlet holes of the microchannel on the film with an inlet reservoir (left) and a passive pump (right), respectively.

The assembly of FIG. 13B could allow a sample to be loaded in the inlet reservoir, and the passive pump will induce flow of that sample through the microfluidic channel and across the immobilized capture reagents for a volume and flow rate defined by the design of the pump. This induced flow could be programmed to minimize the target depletion layer over the capture reagents and maximize the sensitivity of the diagnostic test. A similar assembly could be used for other applications.

Example 2

Programmable Time Delays for the Passive Pumps

This example experimentally demonstrates how to introduce time delays into the flow rate profiles produced by the passive pump assembly. Such flow delays can be used to begin the desired flow rate at a time after the point that fluid actually reaches the inlet region of the passive pump or to temporarily delay the continuation of the flow. This level of control may be desirable if additional time is needed for sample loading or reagent incubation, for example. A varying amount of sucrose or polyvinyl alcohol (or functionally equivalent material) can be dried in the fluid inlet and/or resistive region of the pump to delay fluid transport. Upon imbibition of a fluid such as water into the fluid inlet and/or resistive region, the dried solute will be dissolved, increasing the viscosity of the solution in that region of the paper according to the solute concentration (Table 1). Different solutes can be selected, particularly when using fluids other than water; the use of sucrose dried in the resistive region of a pump is described in this example.

TABLE 1

Viscosity of various sucrose solutions at 20° C.

| % Sucrose (w/w) | Viscosity (cP) |
|---|---|
| 0 | 1 |
| 20 | 1.94 |
| 40 | 6.15 |
| 50 | 15.4 |
| 60 | 58.37 |

Because resistance of a given segment of wetted paper is proportional to the viscosity of the liquid (Equation 2), dissolved sucrose can produce a significant increase in the resistance and decrease in the volumetric flow rate in the passive pump.

Since the neck is designed to be the controller of the flow rate, the flow rate increases and the pump 'turns on' once the fluid in the neck no longer contains the concentrated sucrose. When the dissolved sucrose reaches the absorbent section of the passive pump, the cross sectional area of the wetted front increases, decreasing the length of the viscous plug. This decreases the overall resistance to fluid flow (Equation 2), increasing the flow rate toward the limit established by the resistance of the neck for the fluid without the sucrose.

Example 3

Hybrid Pump Assemblies to Alter Flow Rates at Decreasing Steps

Figure 14A:
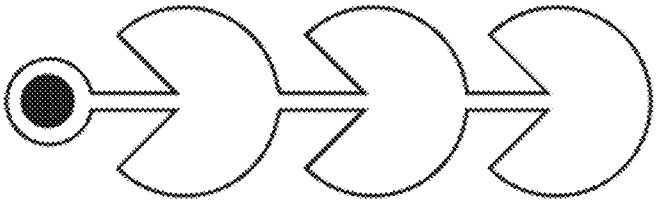
FIGS. 14A and 14B illustrate a schematic of a pump having one flow rate for a period of time and a second, lower flow rate for a given time, and finally a third, even lower flow rate for a given time, according to one embodiment.
Figure 14B:
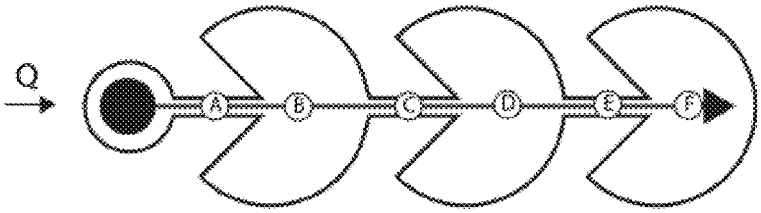
Figure 14C:
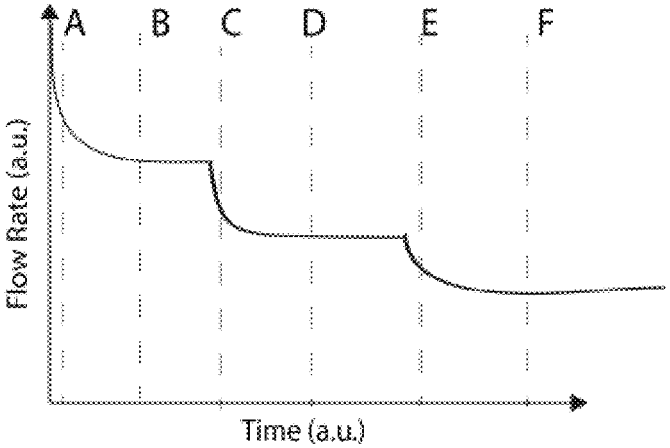
FIG. 14C illustrates the flow rate versus time at various points A-F along the pump. The various points are shown in FIG. 14B.

For some applications, it can be desirable to pump at a given flow rate for a given time and then decrease the flow rate to another flow rate for a second given time. Multiple, sequential flow rates (either increasing or decreasing) are also desirable for some applications. Hybrid pumps that include a plurality of resistive regions and absorbent regions can be used to provide such flow rates. For example, multiple absorbent regions can be fluidly connected in series via resistive regions as shown in FIGS. 14A and 14B. In this example, the flow rate that the pump will generate while the front is between the pump inlet region and the distal end of the first absorbent area will look identical to a pump that does not have sections C, D, E, and F.

Once the fluid front reaches the second resistive region (C), the flow rate will be decreased due to the increasing resistance from the second resistive region relative to the first absorbent region (B). Once the fluid reaches the second absorbent region (D), the flow rate will again be constant. This flow behavior will continue to occur for additional resistive region/absorbent region fluidly connected in series.

Figure 15A:
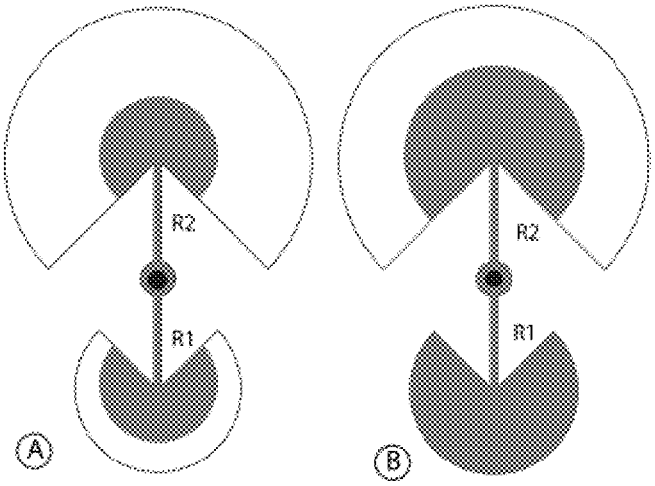
FIG. 15A illustrates a hybrid pump for flow rates with a step decrease according to one embodiment. The flow in the direction of the top absorbent region and the bottom absorbent region are additive.
Figure 15B:
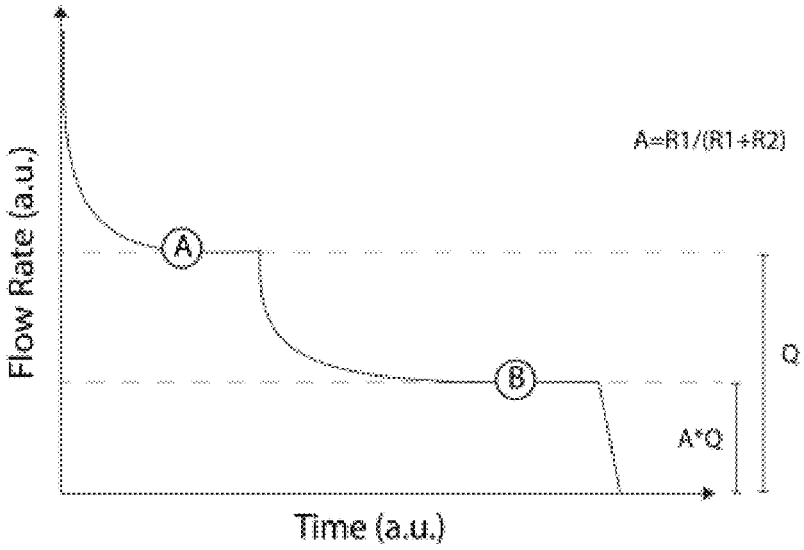
FIG. 15B illustrates the flow rate versus time for the pump shown in FIG. 15A. At time A, both are pumping. At time B, the bottom region is saturated and stops pumping, but the top region continues to pump. A volumetric flow rate with a step decrease is established in the microchannel.

Hybrid pump assemblies can also include multiple absorbent regions fluidly connected in parallel via resistive regions. FIGS. 15A and 15B illustrates an example of such a hybrid pump that generates a step decrease in the flow rate over time. In this example, two resistive regions in the same plane extend from a single fluid inlet (inlet region). Each resistive region is fluidly connected to an absorbent region. As fluid flows into the pump and reaches the absorbent regions, the time-dependent flow from the fluid source into the pump is effectively the sum of the time-dependent flows in each of the absorbent regions (R1 and R2). The flow rate versus time shown in FIG. 15B is for the pump shown in FIG. 15A. At time A, fluid imbibes into the porous material of both absorbent regions (R1 and R2). At time B, absorbent region 1 (R1) is saturated and stops pumping, but the other absorbent region (R2) continues to pump fluid. Such a pump would produce a volumetric flow rate with a step decrease is in a microchannel fluidly connected to the fluid inlet.

Example 4

Hybrid Pump to Establish Flow Rates with Increasing Steps

Figure 16A:
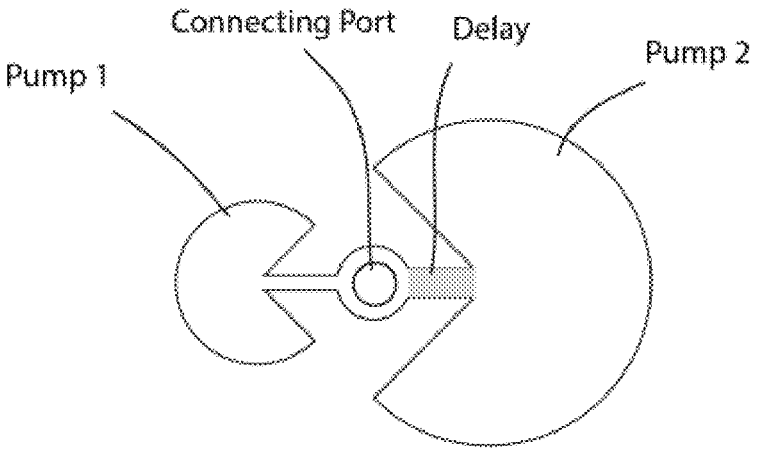
FIGS. 16A and 16B illustrate a hybrid pump according to another embodiment that has two absorbent regions with a delay extending between the connecting port (fluid inlet) and one of the absorbent regions. The pump is designed to pump at one flow rate for a period of time and then pump at a higher flow rate for a period of time once the delay is eliminated.
Figure 16B:
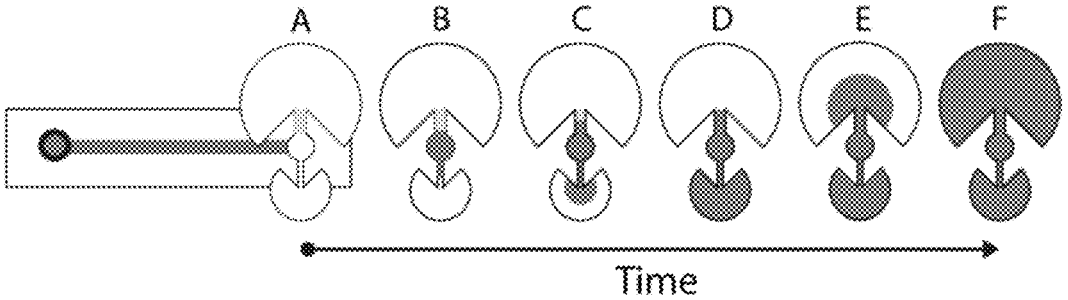
Figure 16C:
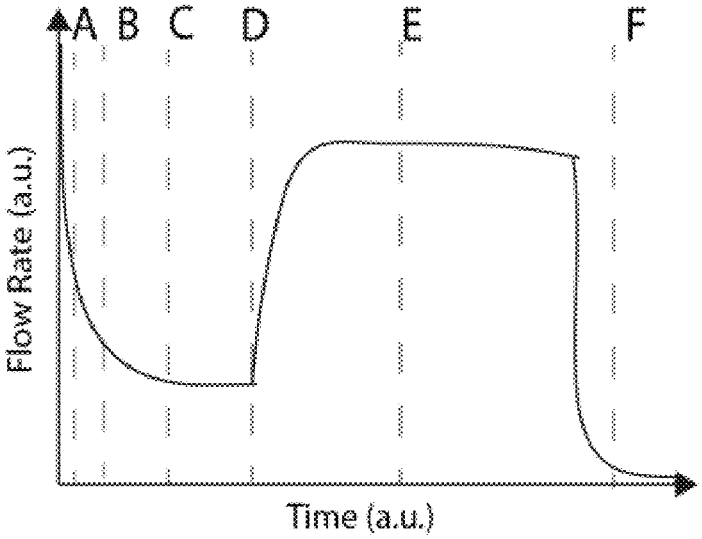
FIG. 16C illustrates the flow rate versus time for the pump shown in FIGS. 16A and 16B at times A through F.
Figure 17:
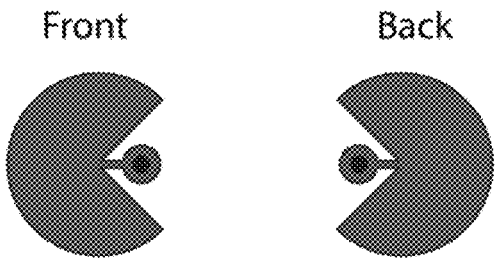
FIG. 17 illustrates a schematic of pumps having open ports on both sides of the inlet pad for stacking, according to one embodiment.

Hybrid pumps can also be designed to pump at one flow rate for a period of time and then pump at a higher flow rate for a period of time. Pumps capable of producing such flow rates can include multiple absorbent regions fluidly connected in parallel via resistive regions. FIGS. 16A-16C illustrates an example of such a hybrid pump that generates a step increase in the flow rate over time. The pump includes two resistive regions—each fluidly connected to an absorbent region—extending from a single fluid inlet (inlet region). If the two resistive regions are sized to originally exhibit different resistances to fluid flow and the lower resistance region has a time delay introduced (e.g., a dissolvable solute disposed in the resistive neck or a dissolvable polymer membrane, such as a polyvinyl alcohol membrane, disposed between the resistive region and the fluid inlet), the hybrid pump will first pump at a lower flow rate (through the resistive region with the greater resistance to fluid flow). Then, after the dissolvable solute generating the delay dissolves and the viscous plug passes out of the second resistive region and into the absorbent region, fluid would be pumped at a higher flow rate.

Example 5

Compound Pumps to Establish Fully Programmable Flow

Instead of making programmable flow rates with hybrid pumps that design multiple pumping areas on a continuous sheet of porous material, multiple laminated, coplanar resistive regions and absorbent regions (referred to herein as pump subunits) can be stacked to form a single compound pump. The individual pump subunits within each coplanar layer can be fluidly connected by a single fluid inlet spanning the height of the stacked subunits as shown in FIGS. 17 and 18A-C.

To generate more complex flow rate profiles, one can stack these subunit pumps at the distal end of the microfluidic channel. This can be used to attach subunit pumps in a manner that might otherwise be impossible using a collection of pumps in the same plane due to physical limitations to space, either between the pump subunits or because of the need to integrate the entire pump into a particular microfluidic device. Solutes generating time delays can be integrated into the resistive region of the appropriate subunit pumps that are to actuate later in a flow process. Time delays can also be generated by inserting a layer of dissolvable material (e.g., a polyvinyl alcohol membrane) between two subunit pumps in a stack (e.g., within the fluid inlet between coplanar layers of the stacked pump assembly). In this approach, the introduction of fluid into components that are after the layer of dissolvable material in the fluid path would be delayed.

Figure 18A:
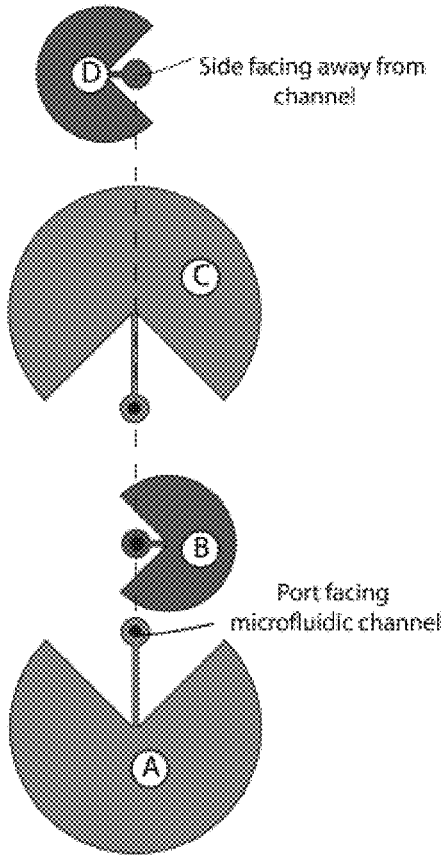
FIG. 18A illustrates pump shapes with known pumping profiles that may be stacked together, according to one embodiment.
Figure 18B:
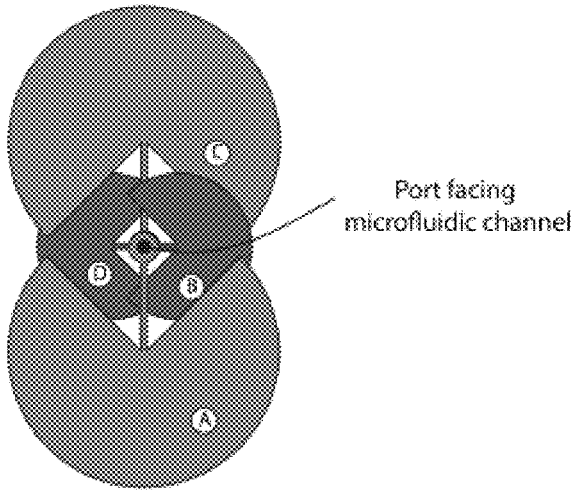
FIG. 18B illustrates the pumps shown in FIG. 18A in an assembled configuration.
Figure 18C:
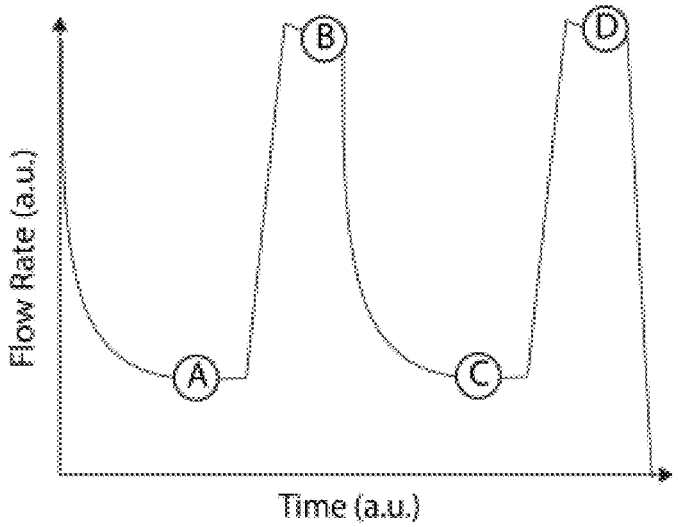
FIG. 18C illustrates an exemplary flow rate versus time for the configuration shown in FIG. 18B at times A through D.

The volumetric flow rate versus time for each subunit pump is additive in this setup to give the changing volumetric flow rates in the microfluidic channel. FIGS. 18A and 18B show an example of the stacked subunit pumps. In this example, subunit pumps B, C, and D have time delays in the neck to start at different times. Because the flow rate versus time is additive, this stack can then generate the profile shown in FIG. 18C.

Figure 19:
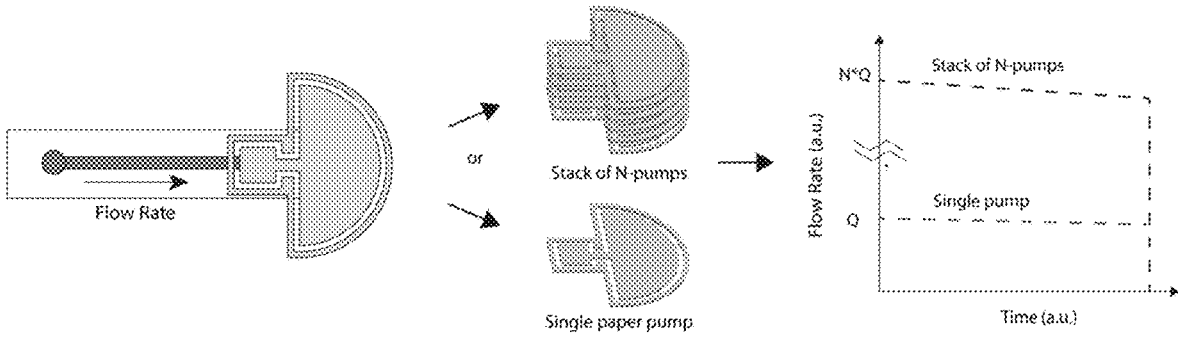
FIG. 19 illustrates a stackable compound pump similar to the compound pump shown in FIG. 18B that can be stacked at an end of a microfluidic channel to get a multiplicative effect on the flow.
Figure 20:
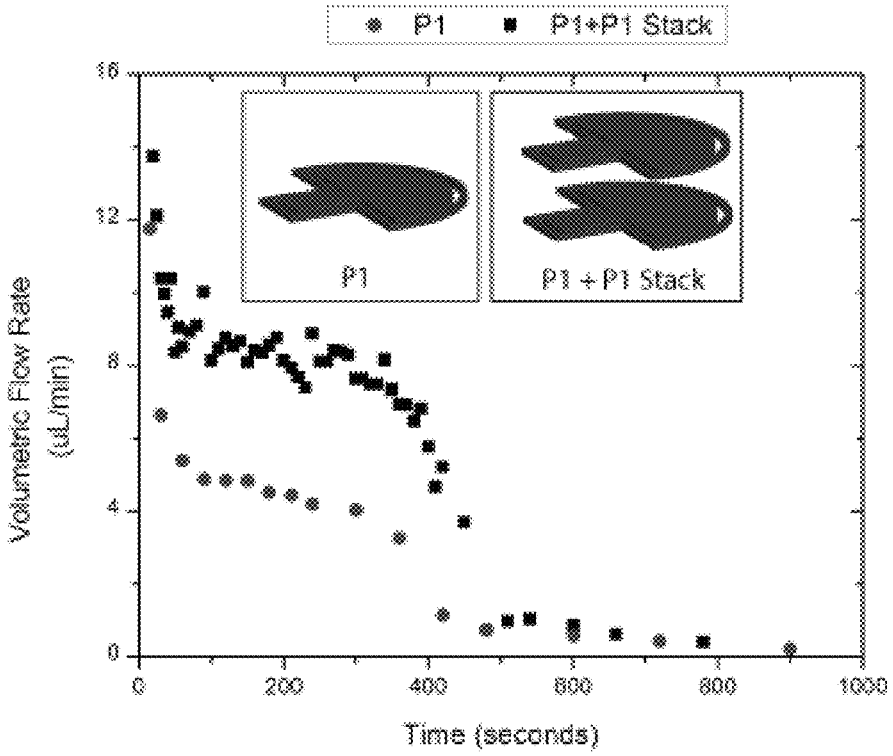
FIG. 20 is a plot comparing the volumetric flow rate as a function of time for a single microfluidic pump and two passive pumps stacked to form a compound pump.
Figure 21:
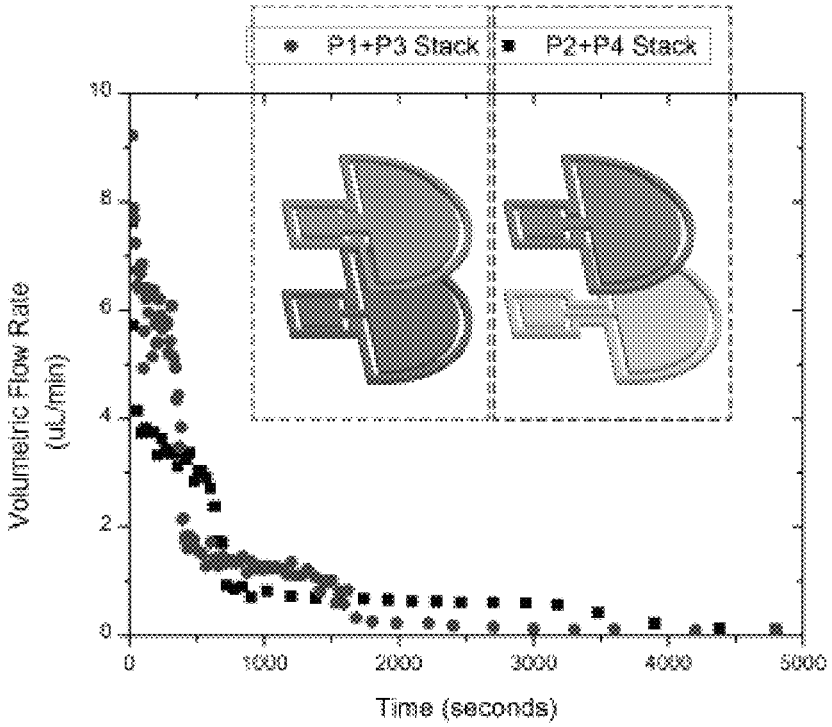
FIG. 21 is a plot comparing the volumetric flow rate as a function of time for two different compound pumps, each of which includes two stacked pump subunits (P1+P3 stack and P2+P4 stack). P1, P2, P3, and P4 each include a resistive region offering a different resistance to fluid flow.

Pump assemblies can also be stacked in order to achieve maximum volumetric flow in minimal space. FIG. 19 illustrates how an exemplary paper pump can be stacked (N subunit pumps) at the end of the microfluidic channel to get a multiplicative effect (N-times) on the flow. FIG. 20 is a plot comparing the volumetric flow rate as a function of time for a single microfluidic pump and two passive pumps stacked to form a compound pump. FIG. 21 is a plot comparing the volumetric flow rate as a function of time for two different compound pumps, each of which includes two stacked pump subunits (P1+P3 stack and P2+P4 stack). P1, P2, P3, and P4 each include a resistive region offering a different resistance to fluid flow. By combining these in varying fashions, complex programmable fluid flow rate profiles can be generated.

Figure 22A:
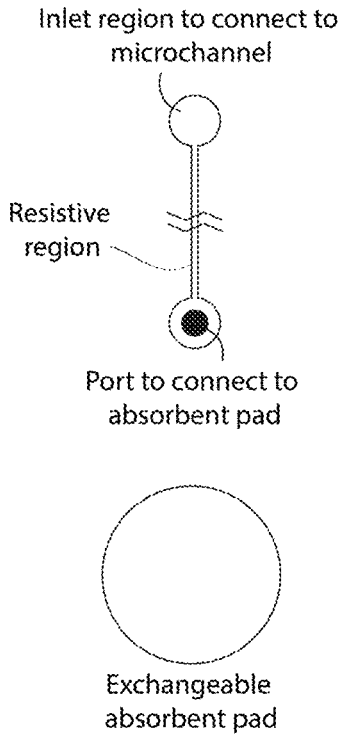
FIGS. 22A and 22B illustrate that stacking may take place at ports other than the one at the end of the microfluidic channel. Using this approach, pumps that include a detachable absorbent region can be fabricated. In these pumps, the absorbent pad can be easily replaced, leaving the resistive region (neck) in connection with the microfluidic channel, and the soaked pad can even be used for subsequent analysis.
Figure 22B:
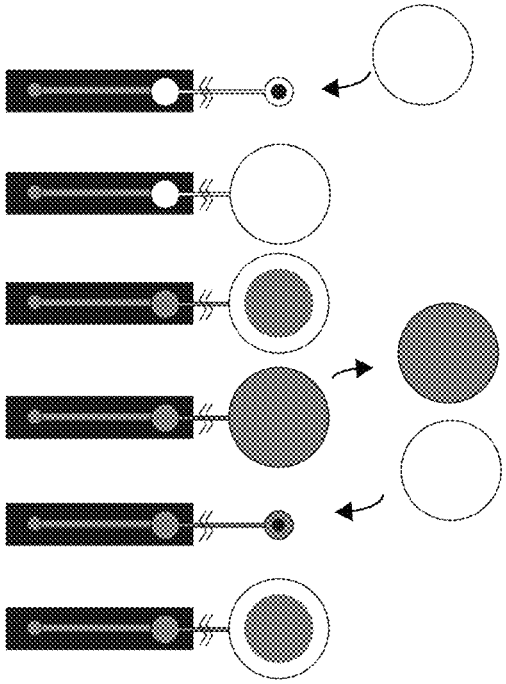

Furthermore, as illustrated in FIGS. 22A and 22B, the pumps can be filled and replaced on a single microfluidic channel. In this example, the absorbent region can be easily replaced, leaving the resistive region in connection with the microfluidic channel in order to maintain constant flow. If the collected fluid is of interest, the filled pumps can even be used for subsequent analysis of samples collected at predetermined time intervals.

Example 6

Pump that has Different Heights in Certain Regions

Figure 23:
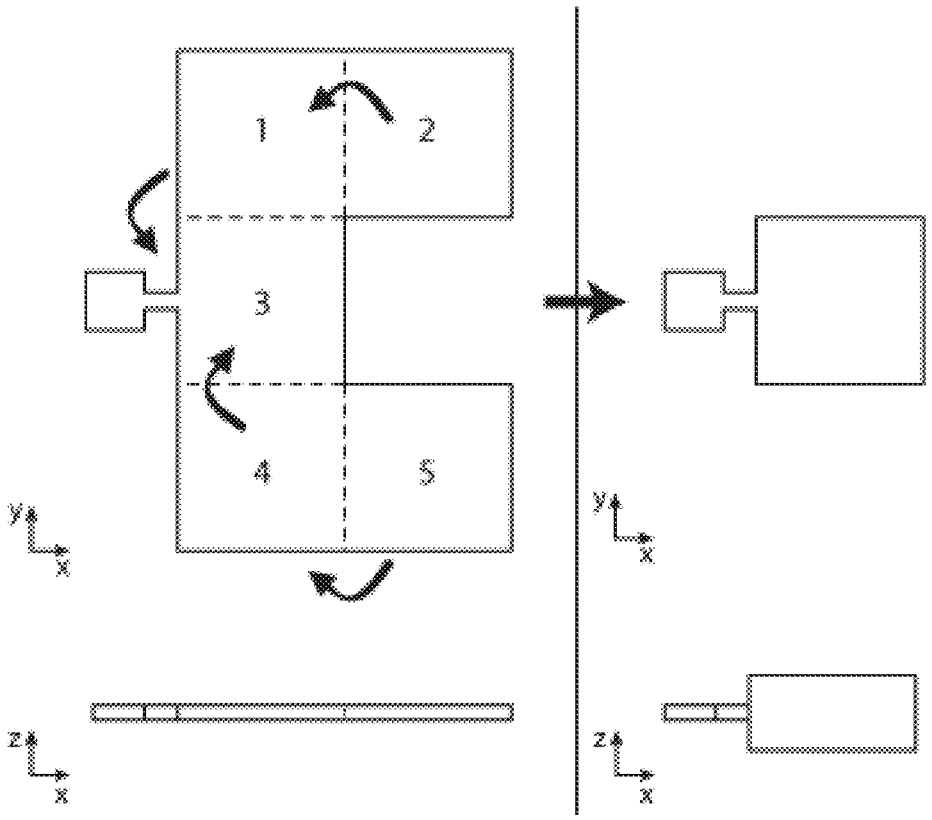
FIG. 23 illustrates a schematic of the steps for fabrication of a pump that has porous material with different thicknesses in different regions. In this embodiment, the surfaces of the different layers of porous media are permeable to the fluid to create an absorbent region that is thicker than the resistive region.

Pumps can be fabricated to include regions of varying thickness. Because the resistance of a porous material is inversely proportional to the area normal to the direction of flow, increasing the height of certain regions of the porous material might be advantageous. For example, it could be particularly useful for the height of the absorbent region of the pump to be higher than the height of the resistive region to make the pump even more constant when the wetted from is in the absorbent region. FIG. 23 shows an example using chromatography paper as the porous material, but this could be used for any planar, porous material. Here, a design is cut into a sheet of paper where copies of the absorbent pad footprint are tiled next to each other. Between the tiled footprints, the porous material was perforated with a laser cutter to allow for easier folding. After folding along the creases, the footprint is the same as it would have been if there were no additional tiled footprints of the absorbent pad, but the absorbent pad is thicker than other regions in the pump. In this specific example, there are no barriers between the faces of the tiled footprints of the absorbent pad.

Example 7

Foldable Pump to Decrease Footprint of a Given Pump

Figure 24:
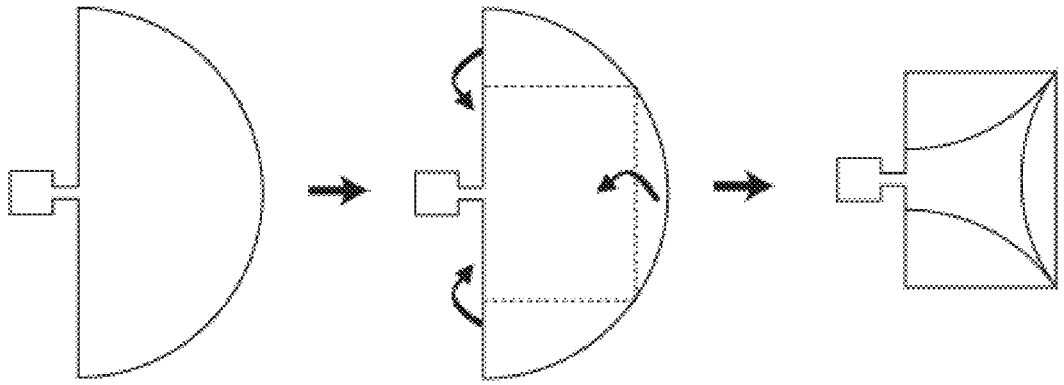
FIG. 24 illustrates a schematic of the steps for fabrication of a pump to decrease the footprint of the pump while keeping the original properties of the pump. In this case, the surfaces of the different layers of the porous media are impermeable to the fluid.

The three-dimensional shape of the absorbent regions of pumps can be modified to decrease the footprint of a given pump without changing the transport properties of the pump. In this case, the porous material is chromatography paper, and there is a fluid-impermeable layer on both faces of the porous material. One situation where this might be useful is if the absorbent region is significantly larger than the other portions of the pump and/or the container that it is intended to fit into. In cases like this and others, the absorbent region can be folded onto itself to decrease its footprint (FIG. 24). With surfaces that do not allow fluid to penetrate, the imbibing fluid follows flow path as if it were not folded and pumps at the same flow rate profile.

Example 8

Programmable Delays Using Dissolvable Membranes

Time delays can also be introduced using dissolvable membranes. In these cases, a dissolvable membrane can be positioned between adjacent portions of porous or non-porous material in a pump or compound pump (e.g., between the fluid inlet pads of two pumps in a compound pump). While the dissolvable membrane remains intact, it can serve as a barrier to fluid flow between these adjacent portions of a pump or compound pump (e.g., between the fluid inlet pads of two fluidly connected pumps in a compound pump). However, once the membrane is breached, fluid can then flow between the adjacent portions of a pump or compound pump.

Suitable dissolvable membranes for use with aqueous fluids can be formed from polyvinyl alcohol (PVA). PVA is a water-soluble polymer that can be cast into films/sheets. Disks can be fabricated out of these films and inserted between inlet regions of stacked pumps. When exposed to a solvent in which PVA is soluble (e.g., water), the film will begin to dissolve. Once the film breaches, the fluid can advance to dry regions of the stacked pumps. This effectively gives a time delay before certain pumps (those downstream of the delay) are turned on. This delay time can be controlled through means such as adjusting the thickness of the film.

Figure 25:
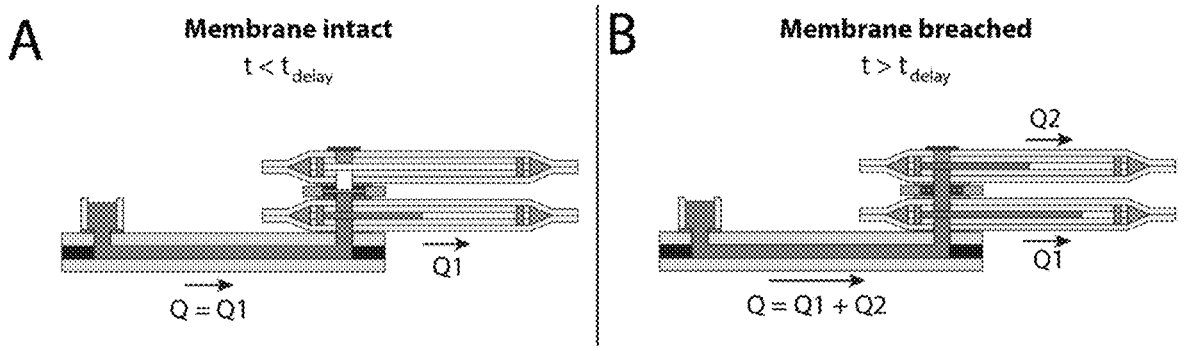
FIG. 25 illustrates an example compound pump that includes a dissolvable membrane disposed between the fluid inlet of two fluidly connected pump subunits of the compound pump. When fluid initially imbibes into the pump (into the fluid inlet of the first pump subunit), the rate of fluid flow through an attached microchannel is governed by Q1 (Panel A). Once the membrane is breached, fluid can imbibe into both pumps, and the rate of fluid flow through an attached microchannel is governed by Q1+Q2 (Panel B).

FIG. 25 illustrates an example compound pump that includes a dissolvable membrane disposed between the fluid inlet of two fluidly connected pump subunits of the compound pump. When fluidly initially imbibes into the pump (into the fluid inlet of the first pump subunit), the rate of fluid flow through an attached microchannel is governed by Q1. Once the membrane is breached, fluidly can imbibe into both pumps, and the rate of fluid flow through an attached microchannel is governed by Q1+Q2.

Figure 26:
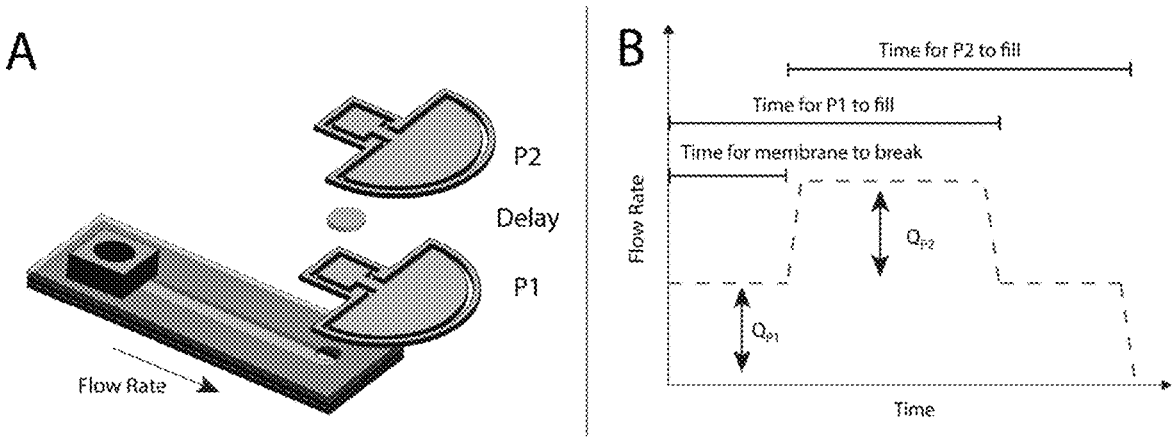
FIG. 26 illustrates a compound pump that includes a dissolvable membrane disposed between the fluid inlet of two fluidly connected pump subunits of the compound pump can be fluidly connected to, for example, a microfluidic channel or a point-of-care diagnostic test. Panel A shows an exploded view of the final assembly. Panel B is a plot illustrating the fluid flow rate through the attached microfluidic device as a function of time.

FIG. 26 illustrates how a compound pump that includes a dissolvable membrane disposed between the fluid inlet of two fluidly connected pump subunits of the compound pump can be fluidly connected to, for example, a microfluidic channel or a point-of-care diagnostic test. Panel A shows an exploded view of the final assembly. Panel B is a plot illustrating the fluid flow rate through the attached microfluidic device as a function of time.

Figure 27:
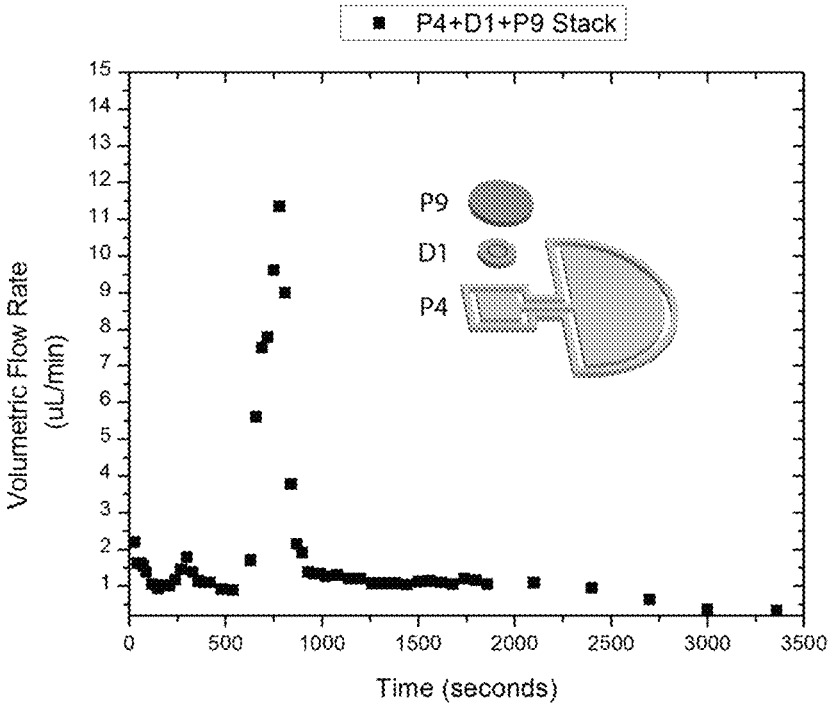
FIG. 27 illustrates an experimental flow rate profile of a compound pump that includes a dissolvable PVA membrane (D1) inserted between the inlet region of a pump (P4) and the inlet region of a pump-like device (P9). P9 is pump-like because it has an inlet region and an absorbent region but no resistive region.

FIG. 27 illustrates an experimental flow rate profile of a compound pump that includes a dissolvable PVA membrane (D1) inserted between the inlet region of a pump (P4) and the inlet region of a pump-like device (P9). P9 is pump-like because it has an inlet region and an absorbent region but no resistive region. Before the membrane bursts, P4 drives fluid at ~1 uL/min. Once the membrane bursts, P9 is fluidly connected and also drives fluid. At this point, the volumetric flow rate significantly increases. The compound continues to pump at this increased flow rate until P9 saturates and stops driving fluid. At this point, P4 is again the sole driver of the fluid, and the volumetric flow rate returns to the ~1 uL/min flow rate.

Example 9

Pumps Prepared Using Varying Porous Materials

Pumps can be prepared from porous materials that have various properties (e.g. capillary pressure, porosity, and permeability). These properties have an effect on the flow rate profile. If, for example, the footprint of the pump needed to be a fixed size, these properties might be chosen to achieve the desired flow rate profile for a given fluid/microchannel. In other examples, a material might be chosen to have a mean pore size that is larger than particles expected to be in the fluid to avoid clogging.

Figure 28:
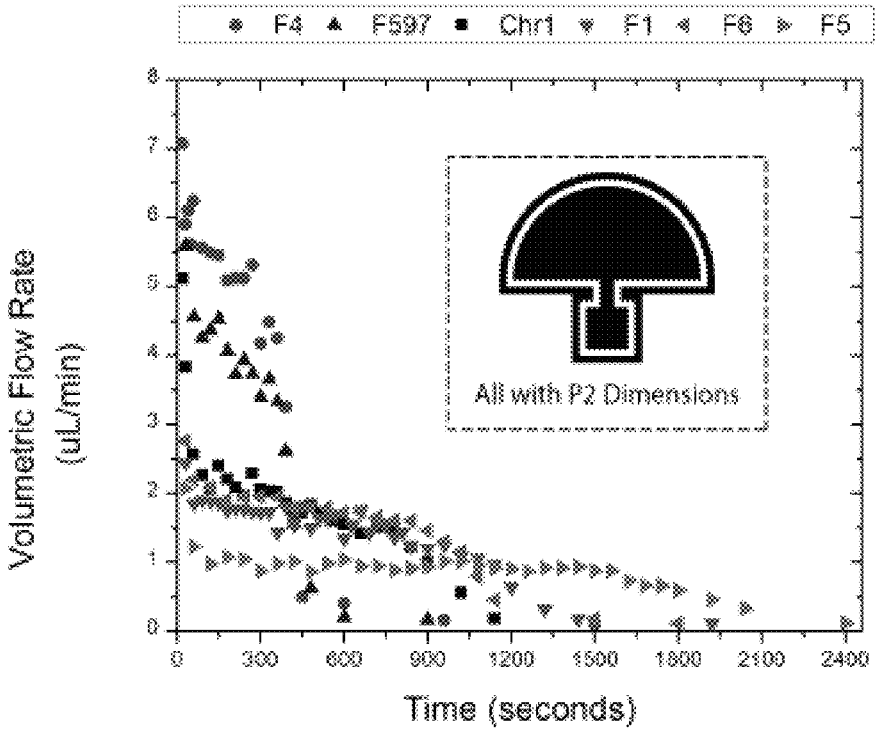
FIG. 28 illustrates flow rate profiles of pumps that are the same shape but made of porous materials with different intrinsic properties (F4, F597, Chr1, F1, F6, and F5).

FIG. 28 illustrates flow rate profiles of pumps that are the same shape but made of porous materials with different intrinsic properties. In this example, these are different types of paper with different mean pore sizes and thicknesses. A range of Whatman papers were used (F4: filter paper #4, F597: filter paper #597, Chr1: chromatography paper #1, F1: filter paper #1, F6: filter paper #6, F5: filter paper #5). The matrix of these papers is made of the same material (cellulose). However, the papers have different mean pore sizes, porosities, and thicknesses. As a result, they have different permeabilities and generate unique capillary pressures. These porous materials were incorporated into pumps with a cross-section similar to that shown in FIG. 7. For the same pump footprint, the different types of paper (with their unique properties) generate unique flow rate profiles.

Using Passive Pump Assemblies in Process and Quality Control

The pumps (including the hybrid pumps and compound pumps described herein) can also be used in process control applications. For example, pumps described herein can be used to determine the fluidic resistance of microfluidic channels, to measure the height of microfluidic channels, to quantify the properties (e.g. the permeability) of a porous material such as paper, and/or to quantify the properties (e.g., the viscosity) of an unknown fluid.

Example 10

Set of Microfluidic Devices to Quantify Viscosity of an Unknown Fluid

The passive pumps described herein can be used in conjunction with a simple microfluidic device to determine the viscosity of an unknown fluid. The microfluidic device can include a microfluidic channel fluidly connecting a fluid inlet to a fluid outlet. The microfluidic channel can contain a pre-loaded fluid. The fluid inlet of a pump that has been well characterized for the imbibition of the pre-loaded fluid can be fluidly connected to the fluid outlet of the microfluidic device. An unknown fluid can be added to the fluid inlet of the microfluidic device, and the device could be actuated to bring the pre-loaded fluid in contact with the passive pump.

The passive pump will induce fluid flow into the microfluidic channel. The rate by which the pump causes fluid to flow will be inversely proportional to the total resistance to fluid flow (which is the sum of the resistance of the pump, the resistance of the plug of pre-loaded fluid, and the resistance of the unknown plug of fluid). To make the flow rate sensitive to the viscosity of the unknown fluid, the total resistance should be dominated by a region where the unknown fluid is flowing. This can be done by the proper design of the pump, pre-loaded fluid, and microfluidic channel. The resistance will be directly proportional to the viscosity of the unknown fluid. Accordingly, the rate of pumping and/or time of pumping can be measured and compared to a calibration curve to quantify the viscosity of the unknown fluid.

Example 11

Ohmmeter for Microfluidic Devices

Microfluidic devices are generally fabricated to have a set of dimensions in an attempt to produce desirable fluid dynamics. However, while the fluid dynamics can be predicted with a computational model, it is generally difficult to characterize microfluidic devices to determine whether devices were fabricated to the original specified dimensions. Measuring the fluidic resistance of a microchannel is one way to determine its physical dimensions.

Figure 29:
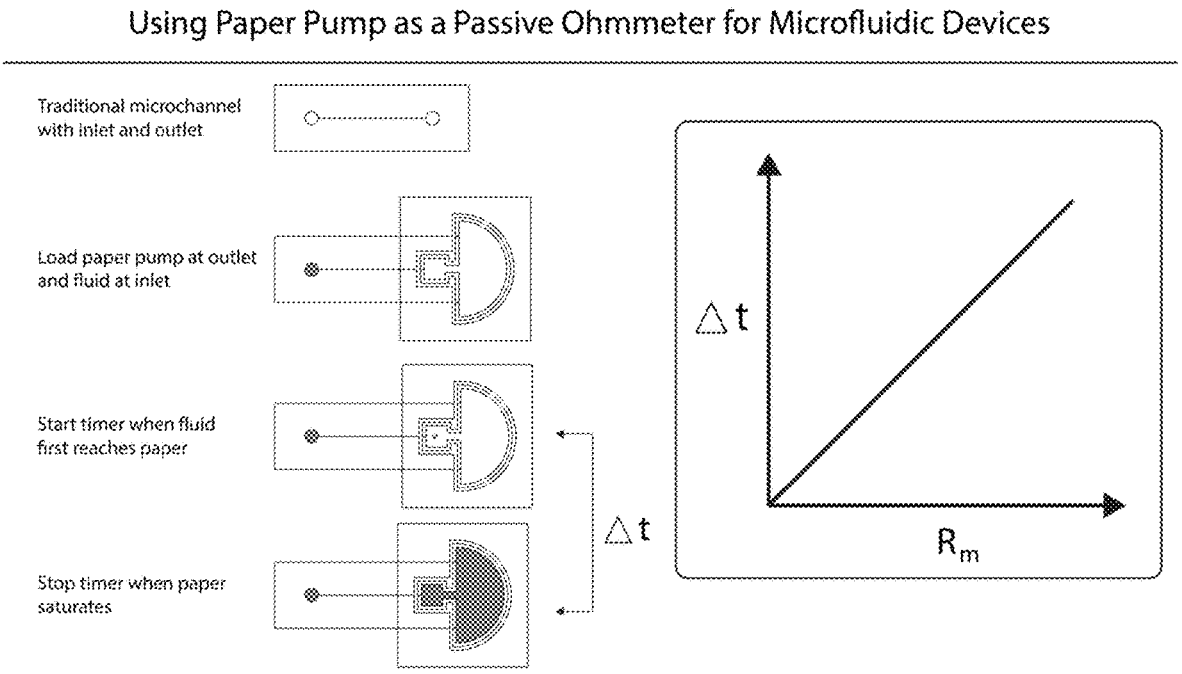
FIG. 29 illustrates a basic schematic of how shaped porous material could be used to measure the resistance of a microfluidic channel.

The passive pump can be used to measure the resistance of a microfluidic channel for cost-effective quality control. For a given pump, the time that the pump takes to fill is dependent on the resistance of the microfluidic device. The resistance of a microfluidic channel can be measured using the setup schematically illustrated in FIG. 29.

One can test the microfluidic channel with a set of passive pumps that have various ranges of quantitation. The lower limit of quantitation of a given pump is dependent on the effective resistance/permeability of that porous material. If the pump's resistance is significantly greater than the microchannel, the pump will likely be unable to quantify the resistance—as the pump's resistance will dominate. If the resistance of the channel is significantly higher than the resistance of the wetted assembly, the channel's resistance would be the dominant controller of the volumetric flow rate. Thus the time that the passive pump takes to fill is directly dependent on the resistance of the microchannel (inset of FIG. 29).

Figure 30:
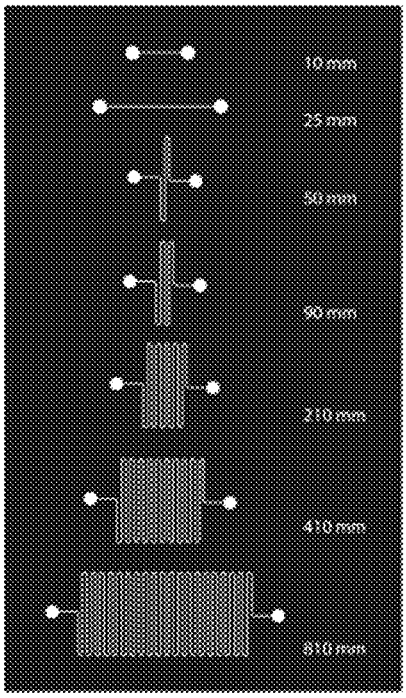
FIG. 30 illustrates a schematic of an exemplary range of lengths of microchannels that can be fabricated with increasing fluid resistance.
Figure 31:
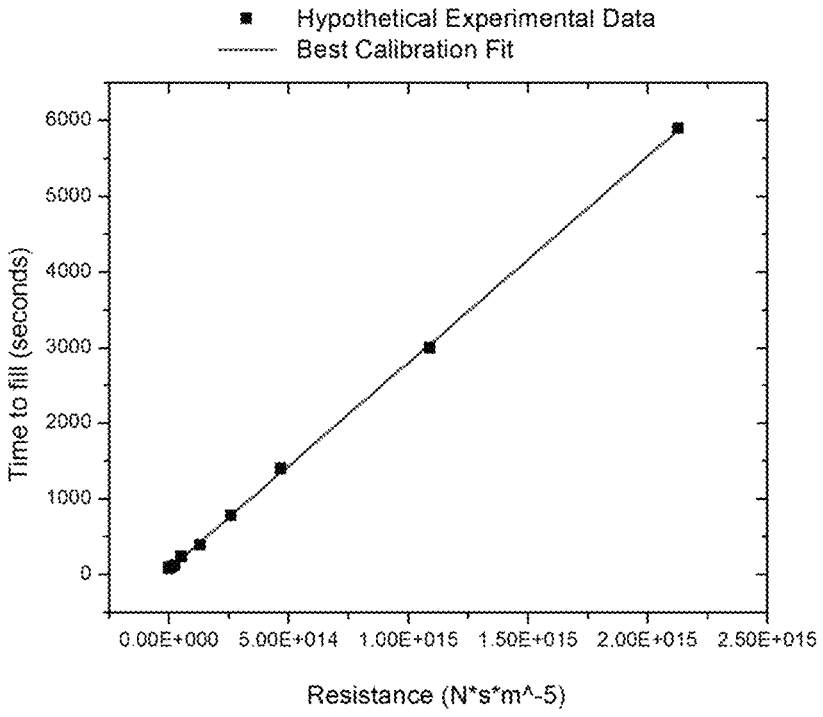
FIG. 31 illustrates hypothetical data for a given passive pump and calibration fit. This calibration curve may be used to test the resistance of a given microchannel by measuring the time to fill.

FIG. 30 illustrates an exemplary range of lengths of microchannels that can be fabricated with traditional techniques and the corresponding amount of resistance of each microchannel. Depending on the height (50 um or 100 um) and width of the channels (50 um or 250 um), the resistances of the microchannels shown in FIG. 30 can range from $6\times10^{11}$ $Nsm^{-5}$ to $4\times10^{15}$ $Nsm^{-5}$. Because the resistance of the microchannel is a function of the length, width, and height of the channels, and the length and approximate width can be determined using standard microscopy, the calculated resistance from the paper pumps can be used to quantify the average height of the channel. For example, FIG. 31 illustrates data for a given passive pump assembly and the calibration fit. The calibration curve could then be used to test the resistance of a given microchannel by measuring the time to fill.

Example 12

Set of Microfluidic Devices to Quantify Properties of a Given Porous Material The flow of fluid in a porous material such as paper can be described with a first order model by knowing the 3D shape and three characteristic properties of the given material and fluid: the effective porosity (Por), capillary pressure ($P_c$), and permeability (K). The product of the capillary pressure and permeability can be determined by tracking fluid flow through a single segment. However, the individual properties are essential to describe the flow fully.

Figure 32:
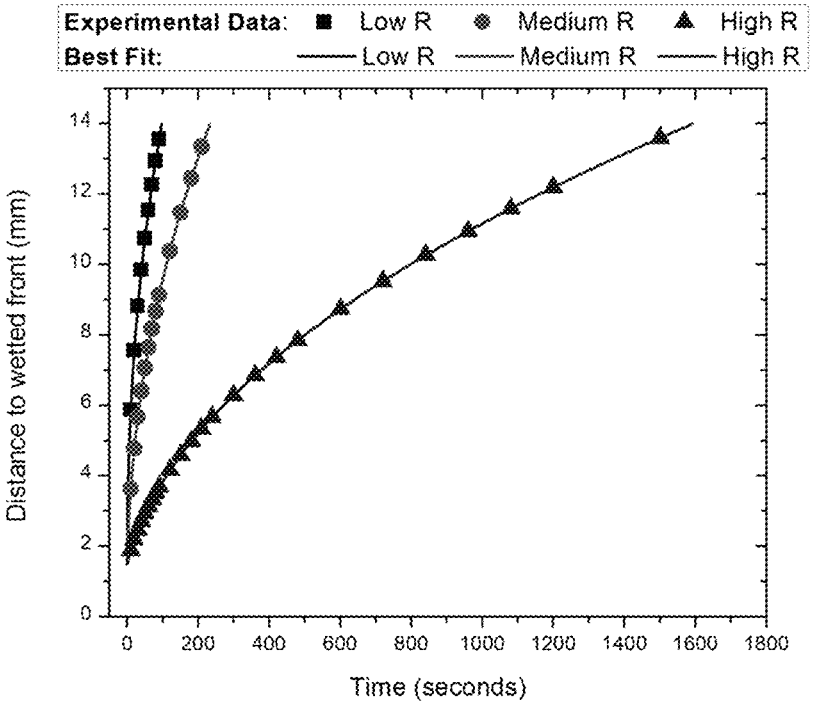
FIG. 32 illustrates hypothetical imbibition data for a given passive pump attached to microchannels of different resistances (low, medium, high) and the best fit of the capillary pressure and permeability of the porous material for each pump.

A set of microfluidic channels with known resistance can be used to quantify properties of porous materials in a rapid, simple measurement. Using the known resistances of microfluidic channels to generate several unique sets of imbibition data can provide solutions for the two unknowns ($P_c$ and K) for the paper or other porous material. A microfluidic channel with a known resistance can be placed between the reservoir and the paper, adding a known resistance in series to the fluidic circuit. These unique sets of imbibition data can then be fit using a least squares approach to identify the $P_c$ and K values that best describe the imbibition of that given fluid into the paper. FIG. 32 illustrates hypothetical imbibition data for a given passive pump attached to microchannels of different resistances (low, medium, and high), and the best fit of the capillary pressure and permeability of the paper for the set of resistors.

This method for determining microfluidic resistance could also be used in process control of paper substrates such as those intended to be used for paper-based microfluidics. A set of microfluidic channels with various resistances, spanning from much lower than the resistance of the paper to much higher resistance than the paper could be used to test different batches of paper. The collected imbibition data could then be used in the model to predict the $P_c$ and K for the given fluid and paper and monitor the functional capacity of the paper.

The devices, systems, and methods of the appended claims are not limited in scope by the specific devices, systems, and methods described herein, which are intended as illustrations of a few aspects of the claims. Any devices, systems, and methods that are functionally equivalent are intended to fall within the scope of the claims. Various modifications of the devices, systems, and methods in addition to those shown and described herein are intended to fall within the scope of the appended claims. Further, while only certain representative devices, systems, and method steps disclosed herein are specifically described, other combinations of the devices, systems, and method steps also are intended to fall within the scope of the appended claims, even if not specifically recited. Thus, a combination of steps, elements, components, or constituents may be explicitly mentioned herein or less, however, other combinations of steps, elements, components, and constituents are included, even though not explicitly stated.

Unless defined otherwise, all technical and scientific terms used herein have the same meanings as commonly understood by one of skill in the art to which the disclosed invention belongs. Publications cited herein and the materials for which they are cited are specifically incorporated by reference.

What is claimed is:

1. A passive microfluidic pump comprising:

(a) a fluid inlet structured to fluidly connect to an upstream fluidic device;

(b) a resistive region dimensioned to control fluid flow;

(c) an absorbent region; and (d) an evaporation barrier enclosing the resistive region and the absorbent region;

wherein the resistive region comprises a first porous medium through which fluid flows from the inlet to the absorbent region, and a fluidly non-conducting boundary;

wherein the absorbent region comprises a fluidly non-conducting boundary defining a volume of a second porous medium sized to absorb a predetermined volume of fluid imbibed from the resistive region, wherein a resistance to fluid flow through the resistive region is at least five times greater than the resistance to fluid flow through the absorbent region, and wherein the resistive region produces and maintains a predetermined fluid flow rate of from 1 nL/min to 100 μL/min as the fluid advances through the second porous medium from the resistive region.

2. The pump of claim 1, wherein the first porous medium and the second porous medium comprise a porous hydrophilic material.

3. The pump of claim 1, wherein the fluid flow rate is effective to deliver the predetermined volume of fluid to the absorbent region in from 10 seconds to 7 days.

4. The pump of claim 1, further comprising a flow delay element influencing fluid flow though the pump.

5. The pump of claim 1, wherein the absorbent region is detachably connected to the resistive region.

6. A compound pump comprising a plurality of fluidly connected pumps defined by claim 1.

7. A method for inducing fluid flow through a microfluidic device comprising:

fluidly connecting a pump defined by claim 1 to a fluid outlet of the microfluidic device; and contacting a fluid inlet of the microfluidic device with a fluid.

8. A method of assembling a passive pump of claim 1, the pump configured to provide a predetermined fluid flow rate within a microfluidic channel, the method comprising fluidly connecting one or more pump subunits shaped to induce a particular fluid flow rate upon contact with a fluid to a fluid inlet to form the passive pump;

wherein each pump subunit comprises a resistive region comprising a first porous medium, and a fluidly non-conducting boundary defining a path for fluid flow through the first porous medium from the fluid inlet to an absorbent region; and the absorbent region comprising a fluidly non-conducting boundary defining a volume of a second porous medium sized to absorb a predetermined volume of fluid imbibed from the resistive region, and wherein a resistance to fluid flow through the resistive region is greater than the resistance to fluid flow through the absorbent region.

9. The pump of claim 1, wherein the resistance to fluid flow through the resistive region is at least ten times greater than the resistance to fluid flow through the absorbent region.

10. The pump of claim 1, wherein the first porous medium and/or the second porous medium comprise fritted glass.

11. The pump of claim 1, wherein the predetermined fluid flow rate is a constant, a step-increase, a step-decrease, or an oscillating rate of flow.

12. The pump of claim 1, wherein the fluid inlet is structured to detachably connect to the upstream fluidic device.

13. The pump of claim 1, wherein the predetermined volume of fluid is from 1 μL to 10 mL.

14. The pump of claim 1, wherein the pump further comprises a second resistive region and a second absorbent region.

15. The pump of claim 14, wherein the second absorbent region is fluidly connected in parallel to the first absorbent region.

16. The pump of claim 15, wherein the second resistive region comprises a third porous medium, and a fluidly non-conducting boundary defining a path for fluid flow through the third porous medium from the fluid inlet to the second absorbent region; and wherein the second absorbent region comprises a fluidly non-conducting boundary defining a volume of a fourth porous medium sized to absorb a predetermined volume of fluid imbibed from the second resistive region.

17. The pump of claim 16, further comprising a flow delay element influencing fluid flow through the pump.

18. The pump of claim 14, wherein the second absorbent region is fluidly connected in series with the first absorbent region.

19. The pump of claim 18, wherein the second resistive region comprises a third porous medium, and a fluidly non-conducting boundary defining a path for fluid flow through the third porous medium from the first absorbent region to the second absorbent region; and wherein the second absorbent region comprises a fluidly non-conducting boundary defining a volume of a fourth porous medium sized to absorb a predetermined volume of fluid imbibed from the second resistive region.

20. The pump of claim 19, further comprising a flow delay element influencing fluid flow through the pump.

21. A passive microfluidic pump fluidly connected to a microfluidic device, wherein the pump comprises:

(a) a fluid inlet structured to fluidly connect to the microfluidic device;

(b) a resistive region dimensioned to control fluid flow rate;

(c) an absorbent region; and (d) an evaporation barrier enclosing the resistive region and optionally the absorbent region;

wherein the resistive region comprises a first porous medium through which fluid flows from the inlet to the absorbent region, and a fluidly non-conducting boundary, and wherein the resistive region produces and maintains a predetermined fluid flow rate;

wherein the absorbent region comprises a fluidly non-conducting boundary defining a volume of a second porous medium sized to absorb a predetermined volume of fluid imbibed from the resistive region, wherein a resistance to fluid flow through the resistive region is at least ten times greater than the resistance to fluid flow through the absorbent region, and wherein the microfluidic device comprises a microfluidic channel fluidly connecting a microfluidic fluid inlet to a microfluidic fluid outlet and wherein the microfluidic fluid outlet of the microfluidic device is fluidly connected to the fluid inlet of the passive microfluidic pump.

22. The pump of claim 21, wherein the fluid inlet is detachably connected to the microfluidic device.

23. A passive microfluidic pump fluidly connected to a microfluidic device, wherein the pump comprises:

(a) a fluid inlet structured to fluidly connect to the microfluidic device;

(b) a resistive region dimensioned to control fluid flow;

(c) an absorbent region configured such that the fluid flow rate stays effectively constant once a fluid front reaches the absorbent region; and (d) an evaporation barrier enclosing the resistive region and the absorbent region;

wherein the resistive region comprises a first porous medium through which fluid flows from the inlet to the absorbent region, and a fluidly non-conducting boundary, and wherein the resistive region determines and maintains a constant, a step-increase, a step-decrease, or an oscillating fluid flow rate;

wherein the absorbent region comprises a fluidly non-conducting boundary defining a volume of a second porous medium sized to absorb a predetermined volume of fluid imbibed from the resistive region, wherein a resistance to fluid flow through the resistive region is greater than the resistance to fluid flow through the absorbent region, and wherein the microfluidic device comprises a microfluidic channel fluidly connecting a microfluidic fluid inlet to a microfluidic fluid outlet and wherein the microfluidic fluid outlet of the microfluidic device is fluidly connected to the fluid inlet of the passive microfluidic pump.

24. The pump of claim 23, wherein the fluid inlet is detachably connected to the microfluidic device.

* * * * *